US006568469B2

(12) United States Patent
Ohmer et al.

(10) Patent No.: US 6,568,469 B2
(45) Date of Patent: May 27, 2003

(54) METHOD AND APPARATUS FOR CONNECTING A MAIN WELL BORE AND A LATERAL BRANCH

(75) Inventors: Herve Ohmer, Houston, TX (US); Mark W. Brockman, Houston, TX (US)

(73) Assignee: Schlumberger Technology Corporation, Sugarland, TX (US)

( * ) Notice: Subject to any disclaimer, the term of this patent is extended or adjusted under 35 U.S.C. 154(b) by 0 days.

(21) Appl. No.: 09/789,187

(22) Filed: Feb. 20, 2001

(65) Prior Publication Data

US 2001/0025710 A1 Oct. 4, 2001

Related U.S. Application Data

(63) Continuation-in-part of application No. 09/196,495, filed on Nov. 19, 1998, now Pat. No. 6,209,648.

(51) Int. Cl.[7] ..... E21B 43/00
(52) U.S. Cl. ..... 166/50; 166/313
(58) Field of Search ..... 166/50, 52, 313, 166/117.5, 241.1

(56) References Cited

U.S. PATENT DOCUMENTS 5,388,648 A * 2/1995 Jordan, Jr. ..... 166/117.5
5,533,573 A * 7/1996 Jordan et al. ..... 166/313
5,823,263 A * 10/1998 Morris et al. ..... 166/191
5,941,308 A * 8/1999 Malone et al. ..... 166/242.3
5,944,108 A * 8/1999 Baugh et al. ..... 166/117.6
5,960,873 A * 10/1999 Alexander et al. ..... 166/117.6
6,035,937 A * 3/2000 Gano et al. ..... 166/117.6
6,073,697 A * 6/2000 Parlin et al. ..... 166/117.6
6,079,488 A * 6/2000 Begg et al. ..... 166/242.6
6,244,337 B1 * 6/2001 Cumming et al. ..... 166/117.6

FOREIGN PATENT DOCUMENTS

| | | |
|---|---|---|
| EP | 0786578 | 1/1996 |
| GB | 2304764 | 9/1997 |
| WO | WO 00/29713 | 11/1998 |

* cited by examiner

*Primary Examiner*—David Bagnell
*Assistant Examiner*—John Kreck
(74) *Attorney, Agent, or Firm*—Trop, Pruner & Hu, P.C.; Jeffrey E. Griffin; Brigitte L. Jeffrey

(57) ABSTRACT

A well completion apparatus and method comprises a junction assembly having a template and a lateral branch connector engageable with the template to couple a main bore to a lateral branch bore. To improve inter-engagement characteristics of the template and connector, one arrangement of the junction assembly utilizes a continuous rail and groove inter-engagement mechanism. In another arrangement, a portion of the rail and groove inter-engagement mechanism is segmented instead of continuous. A method and apparatus is also provided in some arrangements to enable placement of intelligent completion devices in a lateral branch. Additionally, some junction assemblies comprise flow control mechanisms to control commingling, or not, of fluids from different regions in the well bore.

48 Claims, 21 Drawing Sheets

METHOD AND APPARATUS FOR CONNECTING A MAIN WELL BORE AND A LATERAL BRANCH

CROSS-REFERENCE TO RELATED APPLICATION

This is a continuation-in-part of U.S. patent application Ser. No. 09/196,495, filed Nov. 19, 1998 now U.S. Pat. No. 6,209,648.

TECHNICAL FIELD

The invention relates generally to connecting a main well bore and a lateral branch.

BACKGROUND

In the field of multilateral construction and production operations, an important attribute of a junction is the connectivity of the lateral branch with the main bore. Partial or total loss of connectivity of the main bore with a lateral branch may cause fluid production loss. Major connectivity problems may also result in partial or total obstruction of the main or lateral bore at the level of the lateral junction. The consequences are a substantial penalty to the operator of a well in the form of lost opportunity, increased operating cost, or lost production. The root cause of not being able to achieve or maintain connectivity at a lateral junction can be divided into two general areas: mechanical integrity problems and production of solids from formation surrounding the junction.

With some lateral connection assemblies, reliance is made on cement or other filler material to retain the position of the junction. However, cement may not provide sufficient structural integrity, particularly when the formation shifts due to production of fluids, which may crack or fracture the cement. Also, some lateral connection assemblies do not provide adequate sealing against solids (e.g., sand or other debris) in the surrounding formation. As a result, solids may enter the production path, which are produced as contaminants to the surface. The presence of contaminants may damage production equipment. Also, well operation costs may be increased due to the need to dispose such contaminants.

Other shortcomings of conventional lateral connection mechanisms are that some may involve relatively complex deployment procedures or reduced access to sections of the main bore below the junction. A need thus exists for improved lateral connection assemblies and methods.

SUMMARY

In general, according to one embodiment, a lateral junction apparatus comprises a template having a first continuous inter-engagement member, the template having a bore and a window formed therethrough. A connector has a second continuous inter-engagement member adapted to cooperate with the first continuous inter-engagement member to guide a portion of the connector through the window of the template. The connector and template are in engagement along a first length, and each of the first and second continuous inter-engagement members extend substantially the entire first length.

Other or alternative features will become apparent from the following description, from the drawings, and from the claims.

DETAILED DESCRIPTION

In the following description, numerous details are set forth to provide an understanding of the present invention.

However, it will be understood by those skilled in the art that the present invention may be practiced without these details and that numerous variations or modifications from the described embodiments may be possible.

As used here, the terms "up" and "down"; "upper" and "lower"; "upwardly" and "downwardly"; "upstream" and "downstream"; "above" and "below" and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

Figure 1:
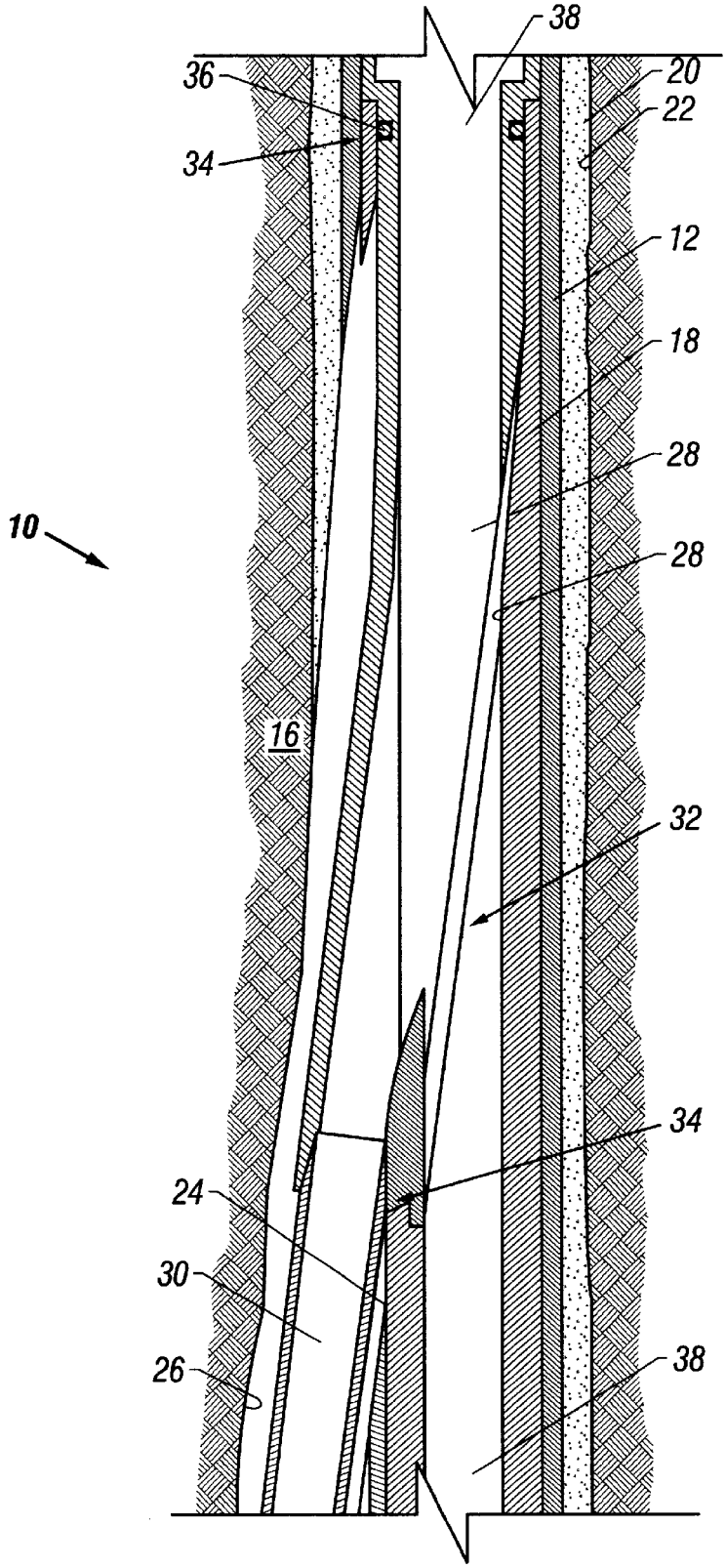
FIG. 1 is a longitudinal sectional view of an embodiment of a junction assembly including a lateral branch template and lateral branch connector.

FIG. 1 illustrates the placement of lateral connection or junction assembly shown generally at 10 within a main well casing 12 of a main well bore 22 that is drilled within an earth formation 16. A lateral branch template 18 is set at a desired location within the main well casing 12, which has been cemented by cement 20 within a main well bore 22. The cement 20 is pumped into the annulus between the well casing and the well bore in the usual fashion and is allowed to harden so that the well casing 12 is substantially integral or mechanically interlocked with respect to the surrounding formation.

A lateral window 24 is formed within the main well casing, either having been milled prior to running and cementing of the main well casing within the bore hole or having been milled downhole after the main well casing has been run and cemented. A lateral branch bore 26 is drilled by a branch drilling tool (not shown) that is diverted from the main well bore through the window 24 and outwardly into the formation surrounding the main well bore. The lateral branch bore 26 is drilled along an inclination that is established by a whipstock or other suitable drill orientation control. The branch bore 26 is also drilled along a predetermined azimuth that is established by the relation of the drill orientation control with an indexing device (not shown) that is connected into the casing string or set within the casing string.

A lateral branch connector 28, engageable within the lateral branch template 18, is attached to a lateral branch liner 30 to connect the lateral branch to the main well bore. A ramp 32 cut at a shallow angle in the lateral branch template 18 serves to guide the lateral branch connector 28 toward the casing window 24 while sliding downwardly along the lateral branch template 18. In addition, as further described below, the lateral branch template 18 and lateral branch connector 28 have cooperable inter-engagement members that, in addition to connection and sealing functions, also serve to guide the lateral branch connector 28 through the lateral branch template 18 and a window 29 of the lateral branch template 18 into the lateral branch bore 26. The window 29 of the template 18 is azimuthally oriented to align to the direction of the lateral branch bore 26.

Optional seals 34 which may be carried within optional seal grooves 36 of the lateral branch connector 28, as shown in FIG. 1, establish sealing between the lateral branch template 18 and the lateral branch connector 28 to provide part of the fluid isolation of the main and lateral branch bores from the environment externally thereof. Once the lateral branch template 18 and lateral branch connector 28 are engaged, fluid communication between the lateral branch bore 26 and a main bore 38 (above the junction assembly 10) is established.

The lateral branch connector 28 is designed to withstand loads that are induced thereto while running the liner 30, attached at the end of the connector 28, into the lateral branch bore 26. Once the lateral branch connector 28 is in fixed position and orientation with respect to the template 18, an interlocking and sealed connection with the lateral branch template 18 is established. The lateral branch connector 28 thus supports a lateral opening, which allows fluid and production tools to pass through the junction between a main production bore 38 (above the junction) and the lateral branch bore 26.

The lateral liner 30 connects to, or alternatively, stabs into the lateral branch connector 28 at its upper end and connects to the upper portion of a lateral liner (not shown) that has been installed prior to installing the connecting apparatus. In the alternative, the lateral liner 30 sets into the open wellbore of the lateral branch along its entire length or along a portion of the lateral branch. The lateral liner 30 also has many properties of liners that are installed in wells to isolate production or injection zones from other formations. The lateral liner 30 may be or may not be cemented depending upon the desires of the user. The lateral liner's sealed and mechanically interlocked relation with the lateral branch template 18 obviates the need for cementing because, unlike conventional cement junctions, the junction assembly 10 is structurally capable of withstanding mechanical or pressure induced forces that cause failure of conventional cemented lateral branch junctions.

As an alternative, the lateral liner 30 may carry inside or outside its wall some reservoir monitoring equipment which measures, processes and transmits important data that identifies the evolution of the reservoir characteristics while producing hydrocarbon products. This information may be transmitted to surface via suitable transmission means such as electric lines, electromagnetic or induction through or along the liner itself provided adequate relays and connections up to the lateral connection with the parent well.

Also, as an option, the lateral branch template 18 may include an active diverting device that is controlled from surface prior to lowering the equipment in a pre-selected lateral branch by creating a temporary mechanical diverter in the main bore.

In accordance with some embodiments, as shown in FIGS. 7A–7D, a continuous interlocking mechanism provided between the lateral branch connector 28 and the lateral branch template 18 includes continuous inter-engagement members. The continuous inter-engagement members provide improved interlocking characteristics (such as connection and sealing characteristics). In addition, the continuous interlocking mechanism provides improved sealing characteristics to prevent or reduce the influx of solids (e.g., sand and other debris) from the surrounding formation and wellbore.

Figure 7A:
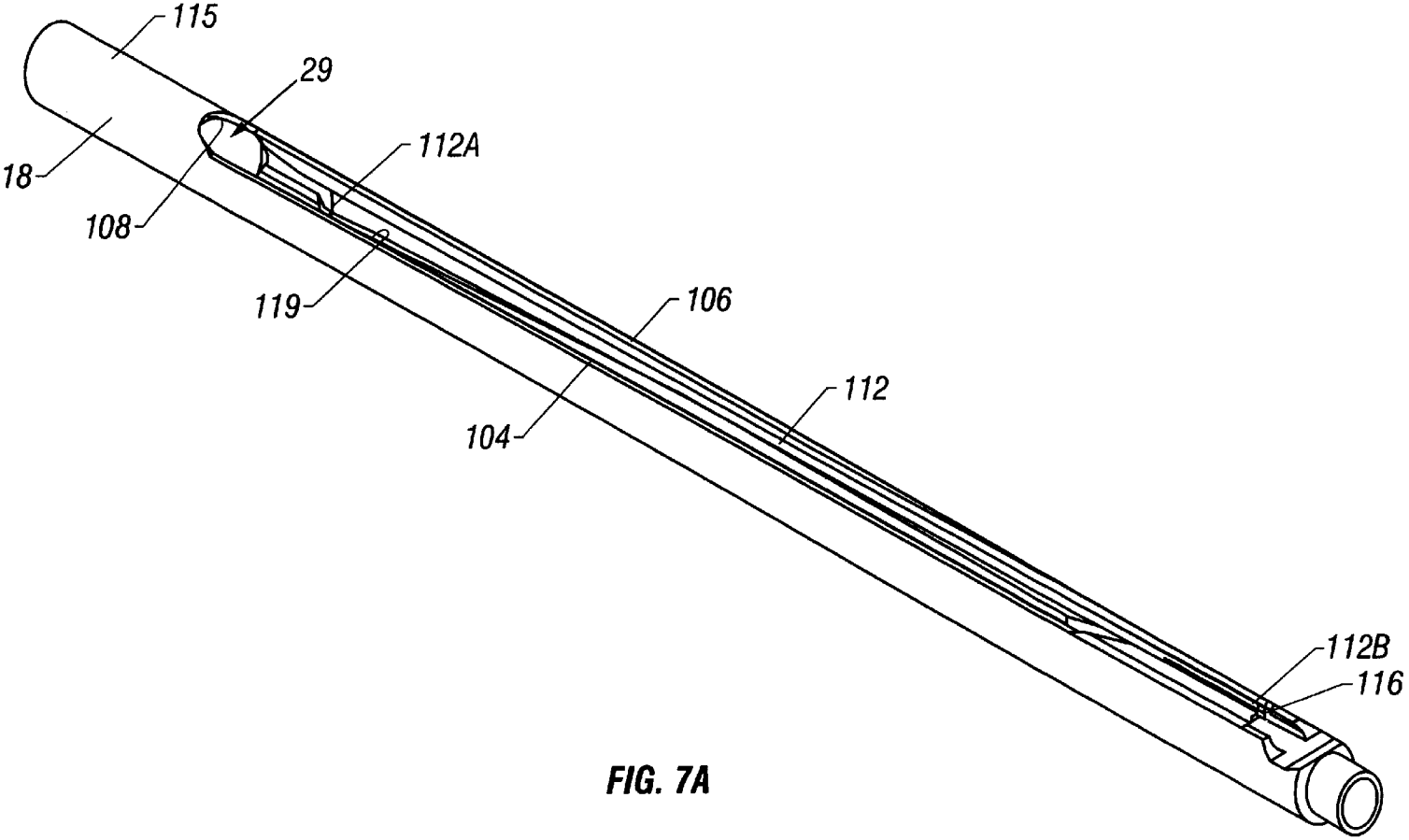
FIG. 7A is a perspective view of the lateral branch template of FIG. 1, in accordance with an embodiment.
Figure 7B:
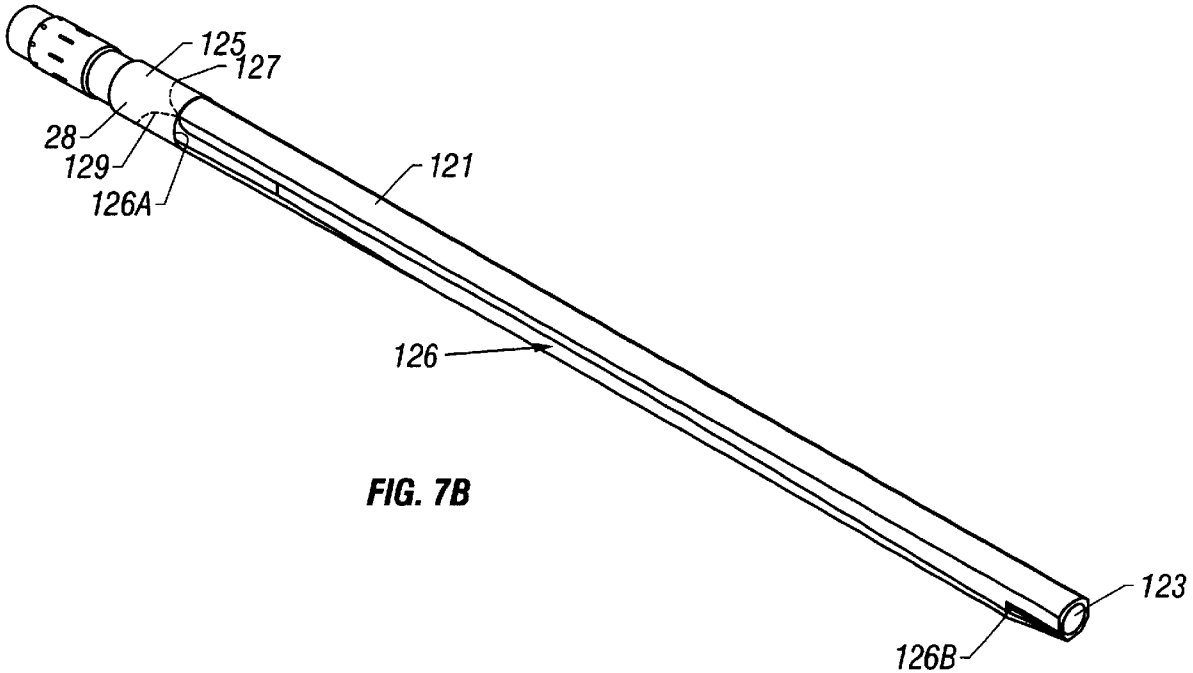
FIGS. 7B and 7C are perspective and side views, respectively, of the lateral branch connector of FIG. 1, in accordance with an embodiment.
Figure 7C:
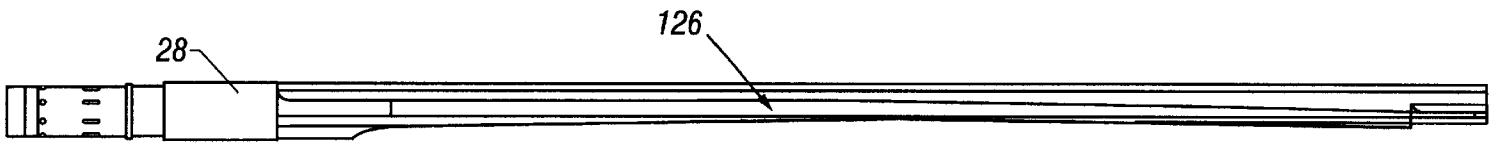
Figure 7D:
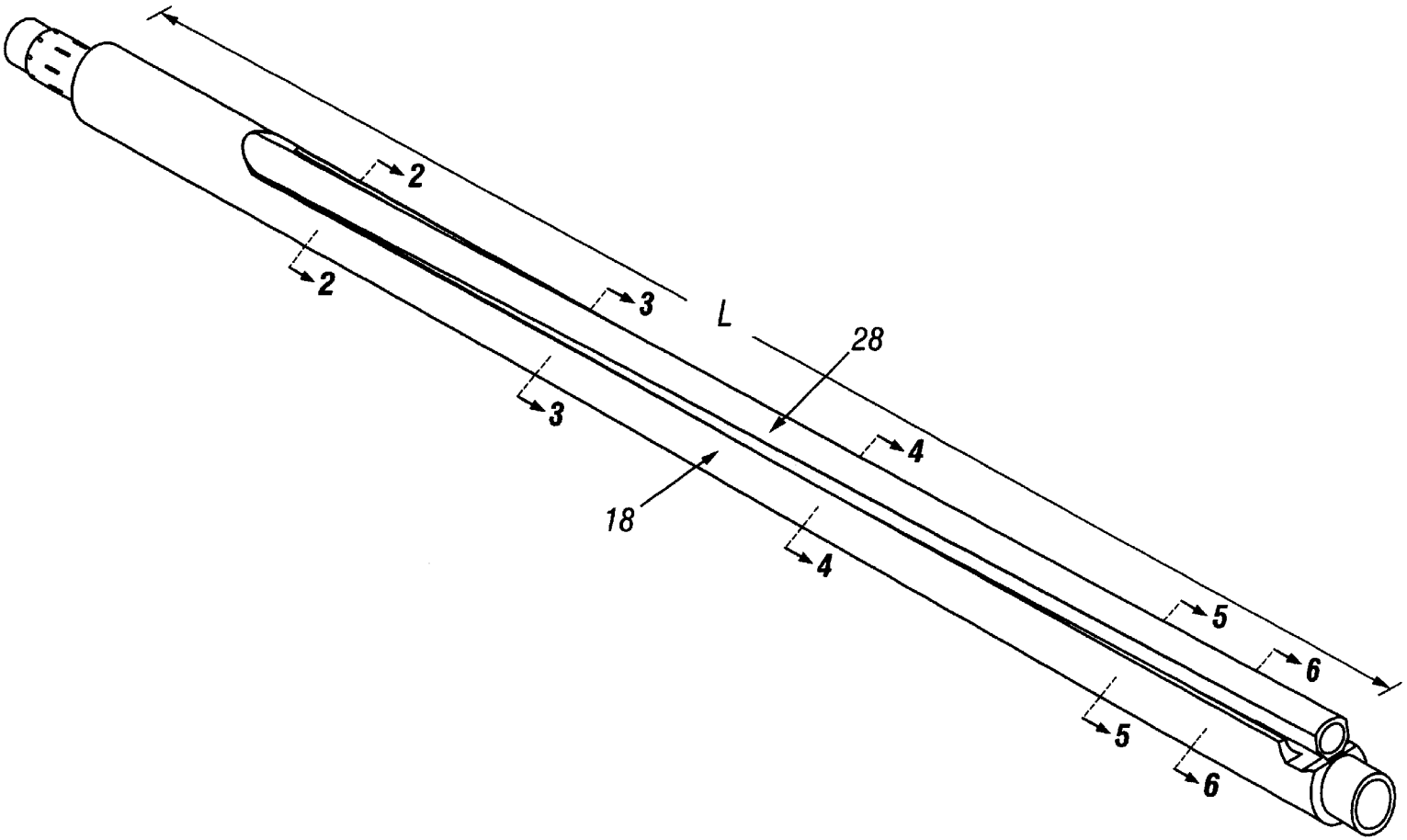
FIG. 7D is a perspective view of an assembly of the lateral branch template and the lateral branch connector in an engaged position.

As shown in FIG. 7D, the lateral branch template 18 and the lateral branch connector 28 are engaged with each other along a length indicated generally as "L." As used here, a "continuous interlocking mechanism" according to one embodiment is one that continuously extends along the length of engagement (L) of the lateral branch connector 28 and the lateral branch template 18, without any breaks or gaps in the inter-engagement members along the lengths of the inter-engagement members. Generally, the inter-engagement members in some embodiments extend from one end (e.g., upper end) of the template lateral window to the other end (e.g., lower end) of the template lateral window. However, in an alternative embodiment, one or both of the inter-engagement members may be formed with one or more gaps or breaks (discussed further below).

In FIG. 7A, the inter-engagement members of the template 18 include a pair of continuous grooves 112 (only one of the grooves is visible in FIG. 7A) formed on the inner wall of the template 18. The continuous grooves 112 are adapted for engagement with a corresponding pair of continuous tongues or rails 126 (only one of the rails 126 is visible in FIGS. 7B–7C) formed on the external surface of the connector 28, as shown in FIGS. 7B–7C. In another arrangement, the grooves 112 are formed in the connector 28 and the rails are formed on the template 18. In yet further embodiments, other types of inter-engagement members can be employed on the connector 28 and template 18.

As shown in FIG. 7A, the lateral window 29 formed through the template 18 is defined by generally parallel side surfaces 104 and 106. The side surfaces 104 and 106 are joined at the upper end by a curved end surface 108. As the lateral branch connector 28 is moved downwardly, the angulated ramp surface 32 (FIG. 1) of the lateral branch template 18, in conjunction with the cooperation of the continuous grooves 112 and continuous rails 126, directs the lower end portion of the lateral branch connector 28 through the window 29.

Each continuous groove 112 has an upper end 112A (the "proximal end") and a lower end 112B (the "distal end"). In the embodiment shown, the width of the groove 112 near the upper end 112A is larger than the width of the groove 112 near the lower end 112B. The width of the groove 112 gradually decreases along its length, starting at the upper end 112A, so that the groove has a maximum width at the upper end 112A and a minimum width at the lower end 112B. In other embodiments, other arrangements of the continuous grooves 112 are possible. For example, each continuous groove can have a generally constant width along its length. Alternatively, instead of a gradual variation of the groove width, step changes of the groove can be provided.

The enlarged upper portion of each groove 112 provides an orientation mechanism for guiding a corresponding rail 126 of the lateral liner connector 28 into the groove 112. The upper portion of the groove 112 has at least one angulated surface 119 for guiding the connector rail 126.

The lower end 112B of each groove 112 in the lateral branch template 18 defines a lower connector stop 116 which is engageable by the lower end of the connector rail 126 to prevent further downward movement of the lateral branch connector 28 once the connector rails 126 are fully engaged in the grooves 112.

Referring to FIGS. 7B–7C, the continuous rails 126 of the branch connector 28 extend from outer surface on opposite sides of the connector housing 121 (only one of the rails 126 is visible in FIGS. 7B–7C). The lateral branch connector housing 121 defines a bore 123 extending therethrough to enable the flow of fluids (production or injection fluids). As shown in FIGS. 7B–7C, the continuous rails 126 extend substantially along the length of engagement (L in FIG. 9) between the connector 28 and the template 18. The continuous rails 126 are arranged and oriented for engagement with the continuous grooves 112 of the template 18. As the lateral branch connector 28 is moved downwardly within the lateral branch template 18, the inter-engagement members 112 and 126 are moved into interlocking relation with each other.

Each continuous rail 126 has an upper end 126A (the "proximal end") and a lower end 126B (the "distal end"). The width of the upper end 126A is larger than the width of the lower end 126B. The rail 126 gradually decreases in width along its length starting from the upper end 126A. In other embodiments, other arrangements of the rails 126 are possible. The variation of the width of the rails 126 is selected to correspond generally to the variation of the width of the grooves 112 in the template 18.

As shown in FIGS. 7B–7C, the continuous rails 126 incline generally downwardly. On the other hand, the continuous grooves 112 (FIG. 7A) incline generally upwardly. The inclined arrangements of the rails 126 and grooves 112 serve to guide the connector 28 outwardly through the window 29 formed through the template 18 (FIG. 7A) so that the distal portion of the connector is guided into the lateral branch bore 26 (FIG. 1).

Also, as the lateral branch connector 28 is forced to follow the inclined path provided by the inclined grooves 112 and rails 126, the lateral branch connector 28 is elastically and/or plastically deformed to follow the inclined path. Thus, as bending force is applied to the connector housing 121 by the ramping action of the rail and groove interlocks, the connector housing 121 is deformed or flexed to permit its lower end to move through the casing window and into the lateral branch bore. FIG. 7D shows the connector 28 and template 18 in the engaged position.

The continuous rail and groove interlocking mechanism shown in FIGS. 7A–7D forms a lateral branch or junction connection assembly that has sufficient structural integrity to withstand the mechanical force induced during well operation. For example, the mechanical force may be applied by shifts occurring in the surrounding earth formation. Also, forces are induced by the flow of fluid through the junction. The continuous rail and groove interlocking mechanism also prevents solids (such as sand or other debris) from entering the production stream from the lateral branch and permits branch connector movement that establishes efficient sealing with the branch liner 30 of the lateral branch bore.

In an alternative embodiment, instead of a continuous rail 126 as shown in FIG. 7B, the rail 126 can be separated into two or more segments, with gaps or breaks between segments.

Figure 8A:
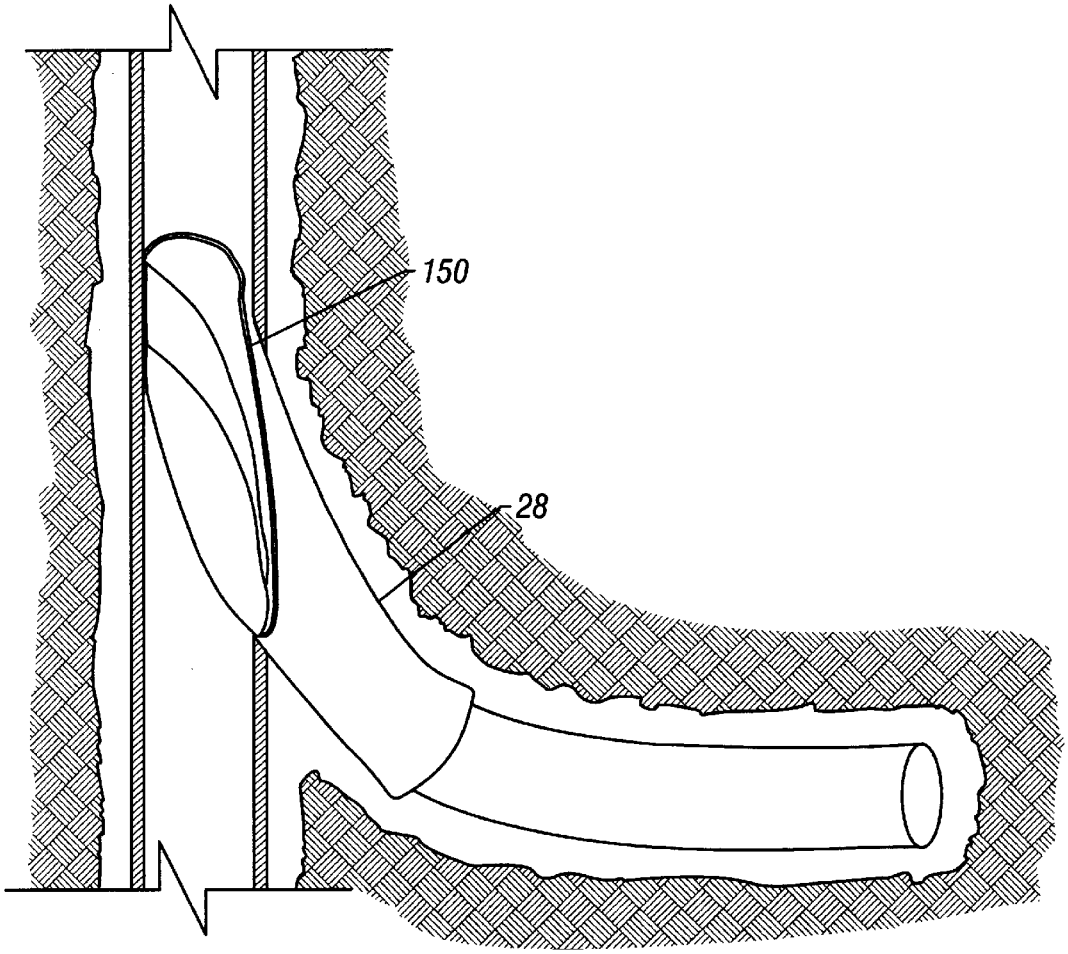
FIG. 8A illustrates a closed, continuous seal path around a lateral window.

Another desired feature of some embodiments of the invention is that a continuous fluid seal path is defined around the periphery of the lateral window 29 of the template. As schematically illustrated in FIG. 8A, the continuous fluid seal path is represented as a continuous, closed curve 150. The fluid seal path can be implemented with a sealing element, such as an elastomer seal. The sealing element is provided between an outer surface of the connector 28 and an inner surface of the template 18. The continuous fluid seal path 150 can be provided when used with either a continuous rail 126 (as shown in FIGS. 7B, 7C) or a segmented or discontinuous rail.

To provide the closed seal path, the sealing element in one embodiment is routed along the rails 126 (FIG. 7B) and runs along the upper portion 125 of the connector 28 either around the front side (indicated as 127) of the upper portion 125 or around the rear side (indicated as 129) of the upper portion 125. A groove can be provided on the upper portion 125 to receive the sealing element.

At the lower end of the continuous seal path 150, the sealing element wraps around, or makes a "U-turn" around the lower end 126B of the rails 126. Thus, when the lower end 126B, and the sealing element wrapped around the lower end, engages the stop 116 (FIG. 1) of the template 18, a sealing engagement is formed between the lower end 126B and the stop 116. By employing the continuous (and closed) seal path 150, isolation around the template lateral window can be achieved.

Figure 8B:
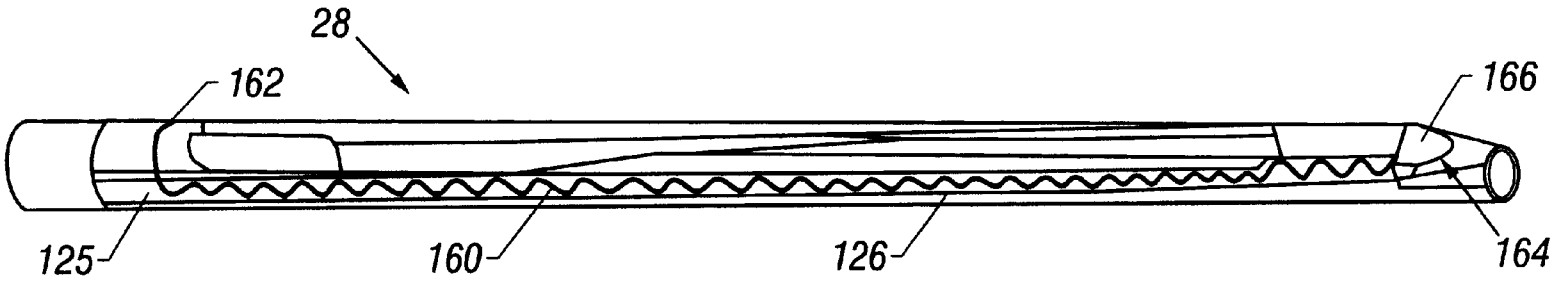
FIG. 8B is a perspective view of an embodiment of a lateral branch connector with a sealing element to provide the closed, continuous seal path.

Referring to FIG. 8B, according to another embodiment, an upside down view of the connector 28 is illustrated. A sealing element 160 runs continuously along the rail 126 on the visible side. The sealing element 160 wraps around (indicated by 162) the upper portion 125 of the connector 28 to the other side of the connector 28, where the sealing element 160 runs on the other rail 126 (not shown). The sealing element 160 may run in a groove along the path 162 in the example. At the lower end of the connector 28, the sealing element 160 runs along a defined path 164 (in a groove, for example) to the other side of the connector 28. When engaged to corresponding surfaces of the template 18, a closed, continuous seal path is defined around the lateral window 29 of the template 18. In the embodiment shown in FIG. 8B, the surface 166 in which the sealing element 160 is routed over is generally inclined or curved. As a result, the gap at the seal portion 164 is gradually reduced as the inclined or curved surface 166 of the connector 28 mates with a corresponding inclined or curved surface (not shown) of the template 18. A sealing engagement is achieved once the connector 28 fully engages the template 18.

In the illustrated example, the sealing element 160 undulates along the rail 126 to form a generally wavy sealing element. The generally wavy form of the sealing element 160 enables a more secure engagement in a groove formed in the rail 126. Other shapes of the sealing element 160 may be used in other embodiments.

Figure 9:
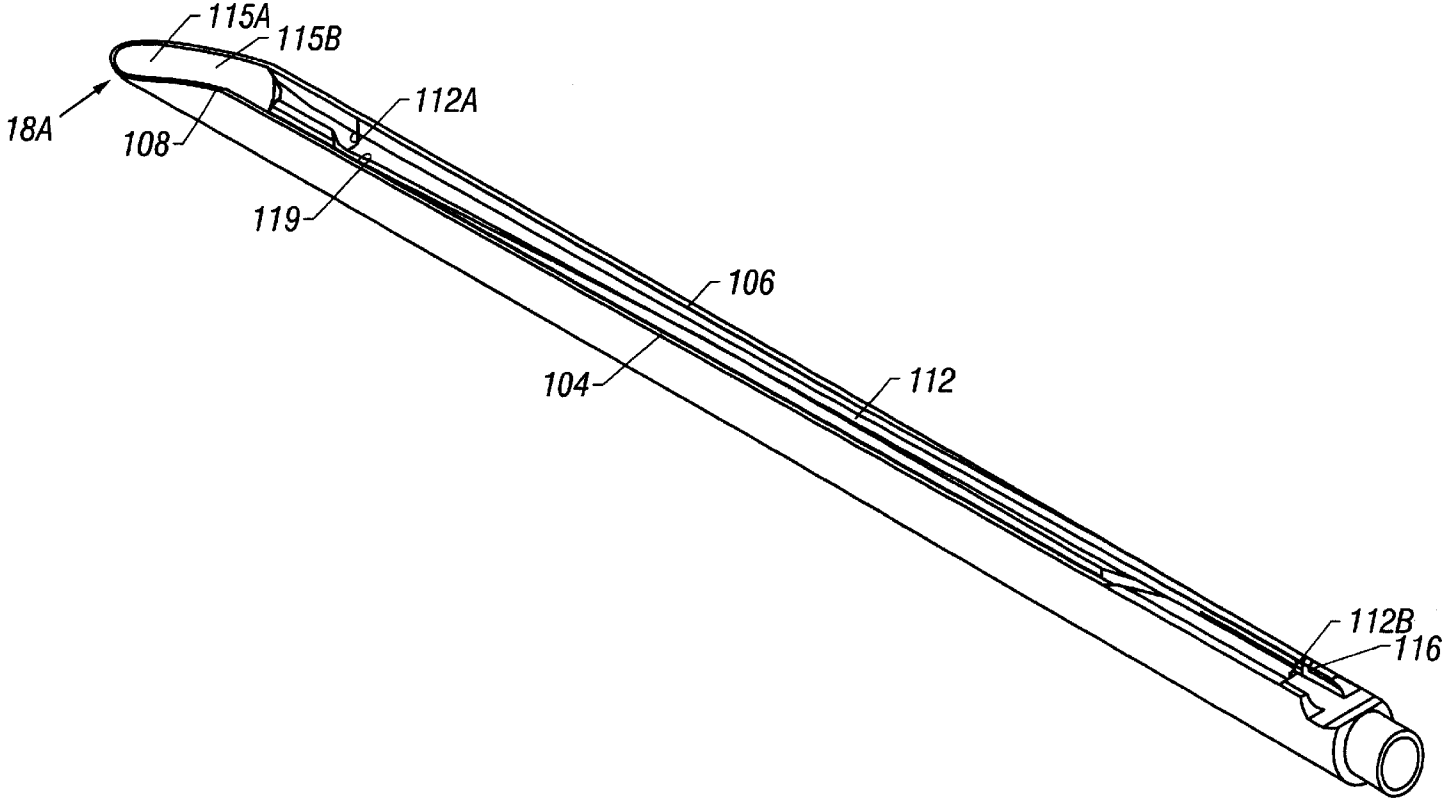
FIG. 9 is a perspective view of another embodiment of a lateral branch template.

In the template 18 shown in FIG. 7A, the upper portion 115 of the template 18 is a tubular housing that encloses an inner bore. However, in an alternative embodiment, as shown in FIG. 9, a template 18A has an upper portion 115A that has an open side 115B. By employing an upper portion that has one side open, a larger space is provided at the upper end of the junction assembly 10 when the connector 28 and template 18A are engaged.

FIGS. 2–6 are cross-sectional views taken along respective section lines 2—2 through 6—6 of FIG. 7D and showing the structural interrelation of the various components of the lateral branch template 18 and the lateral branch connector 28. The template 18 and connector 28 are in the fully engaged position in FIGS. 2–6.

Figure 2:
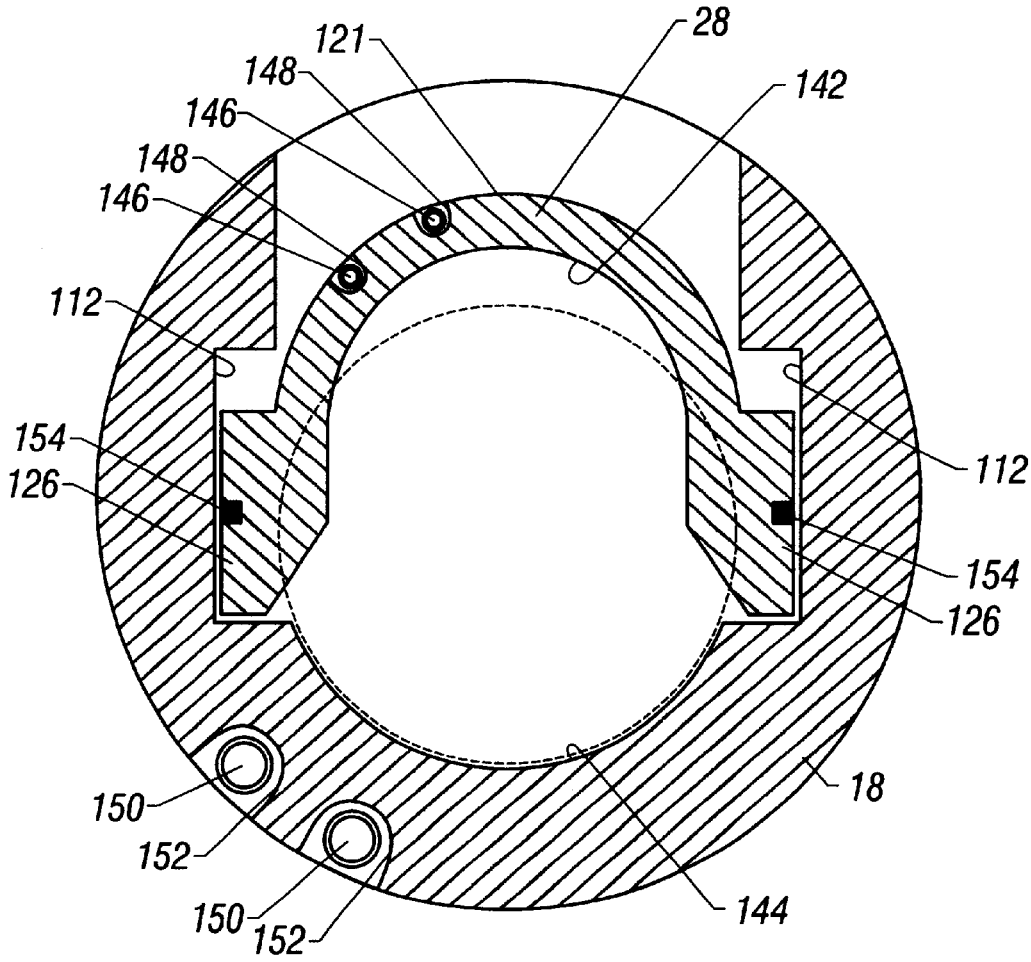
FIGS. 2–6 are cross-sectional views of portions along the assembly of the lateral branch connector and lateral template of FIG. 7D.

FIG. 2 shows a cross-sectional view (at 2—2) near the upper end of the junction assembly including the template 18 and the connector 28. As shown, the upper portion of each of the pair of grooves 112 is wider than a corresponding portion of each of the pair of rails 126. The relatively large width of each groove 112 makes it easier for the rails 126 of the connector 128 to be inserted into the grooves 112. Also, at the position indicated by 2—2, an inner bore 142 of the connector 128 is substantially coaxial with an inner bore 144 of the template 18.

Figure 3:
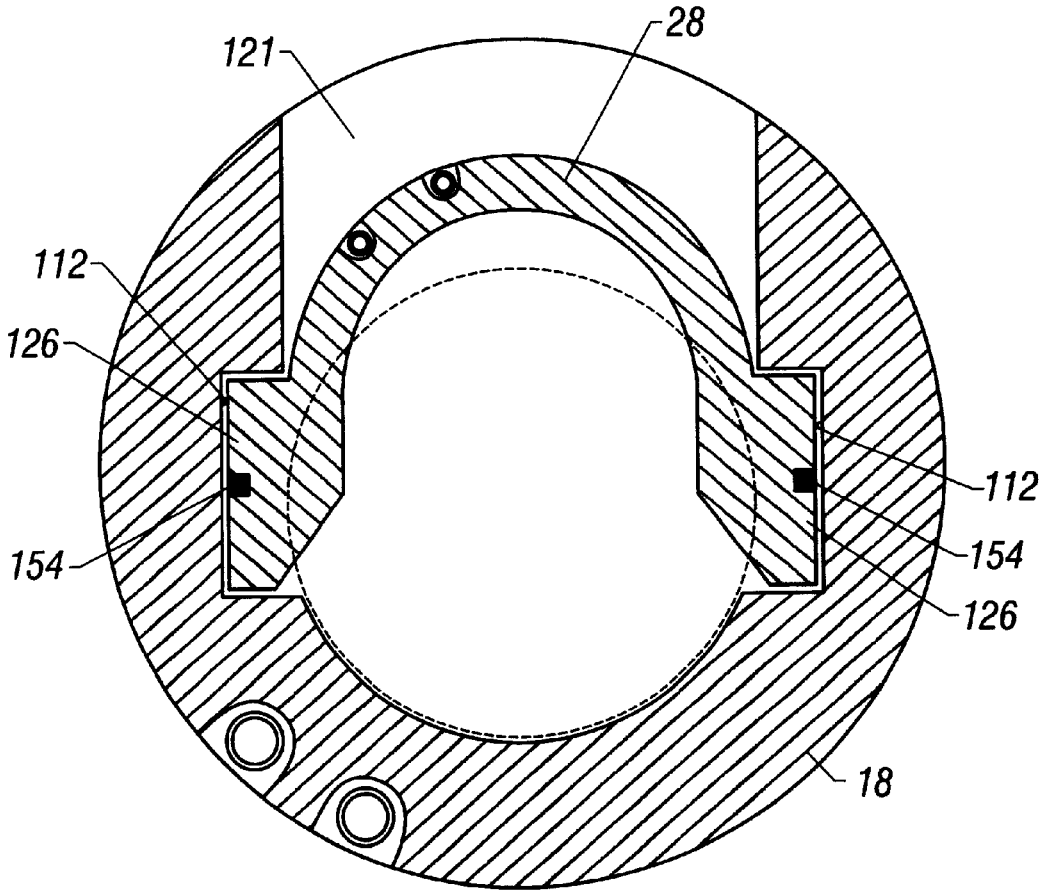
Figure 4:
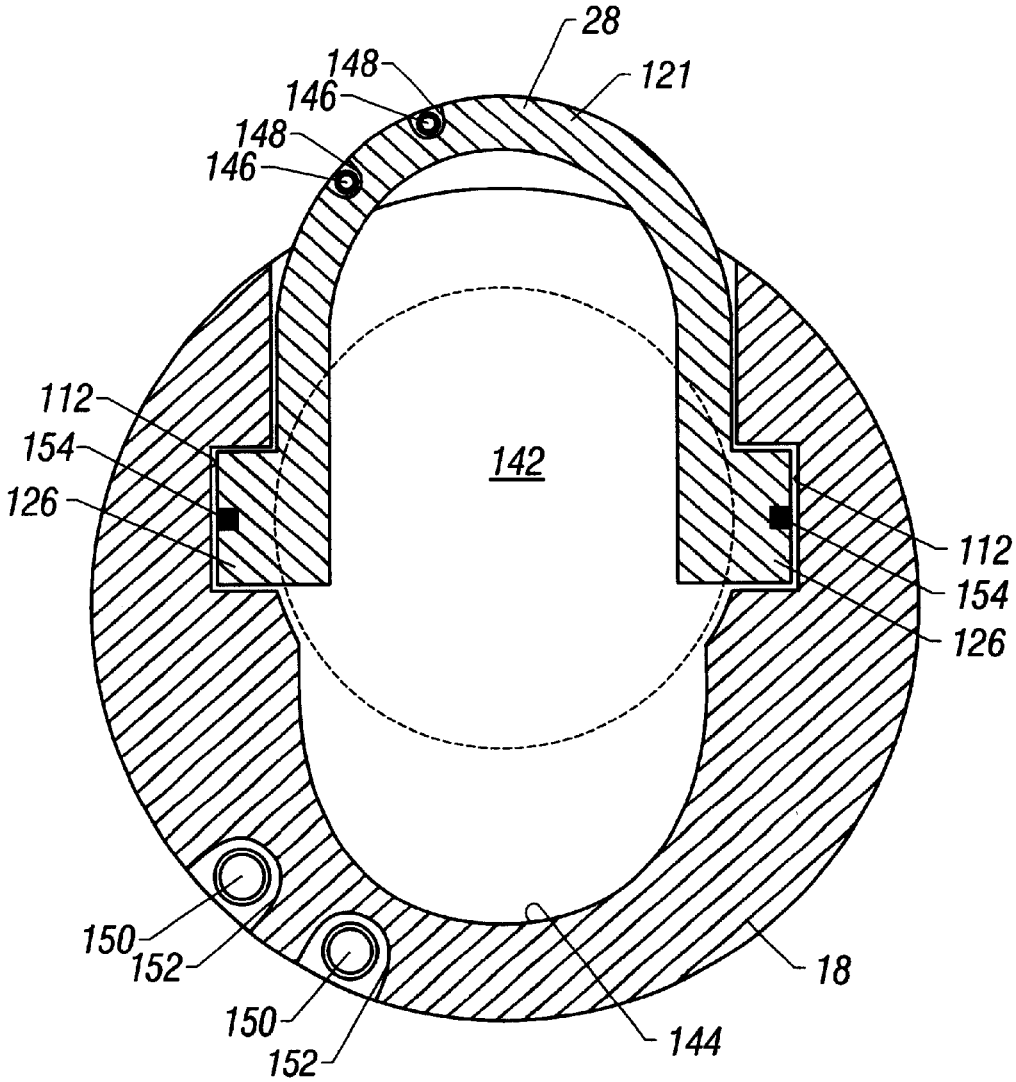

Further downwardly, as shown in FIG. 3 (cross-sectional view at 3—3 in FIG. 1), the inner bore 142 of the connector 28 is slightly offset with respect to the inner bore 144 of the template 18. Also, the width of each groove 112 has narrowed to provide a tighter fit with the corresponding rail 126. The offset between the inner bores 142 and 144 become larger at the cross-section 4—4, as shown in FIG. 4. Also, as shown in FIG. 4, the widths of the grooves 112 and rails 126 are also smaller than the widths at cross-sections 2—2 and 3—3.

Figure 5:
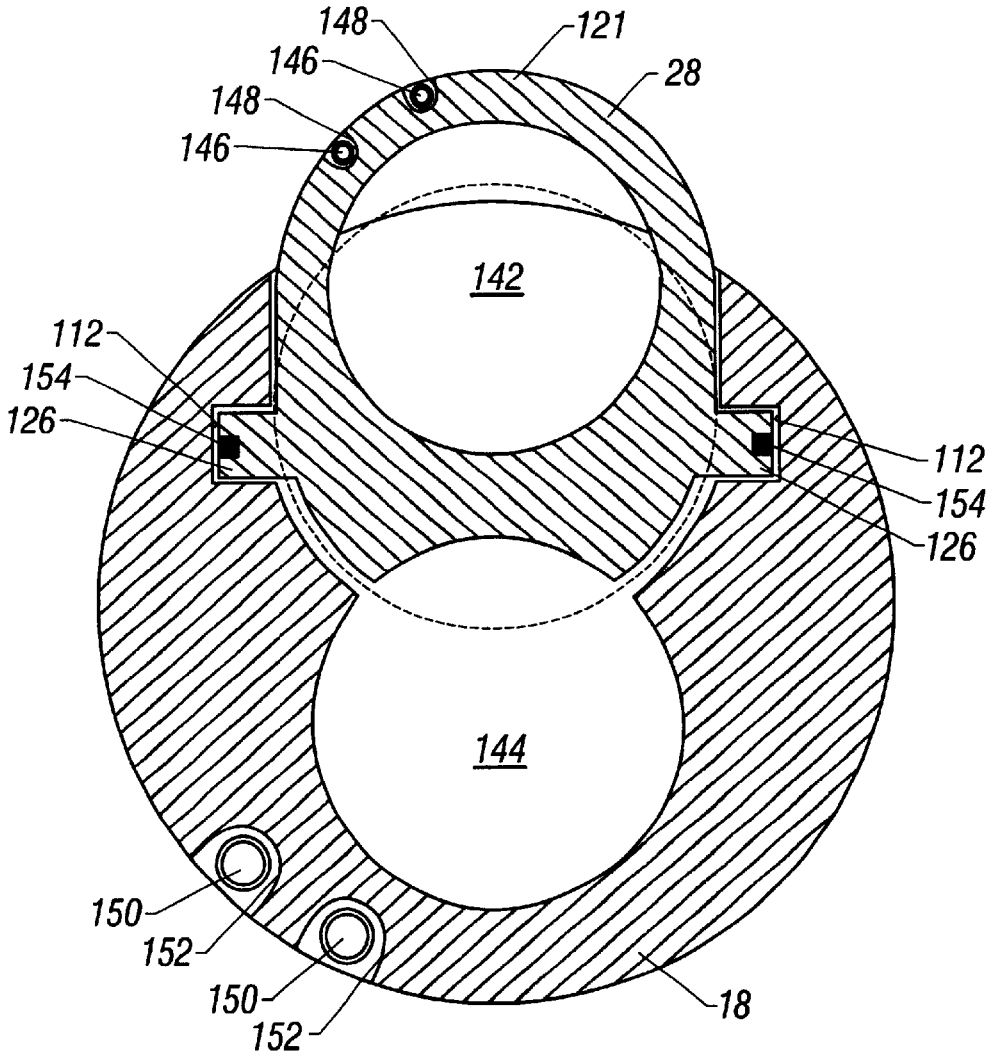
Figure 6:
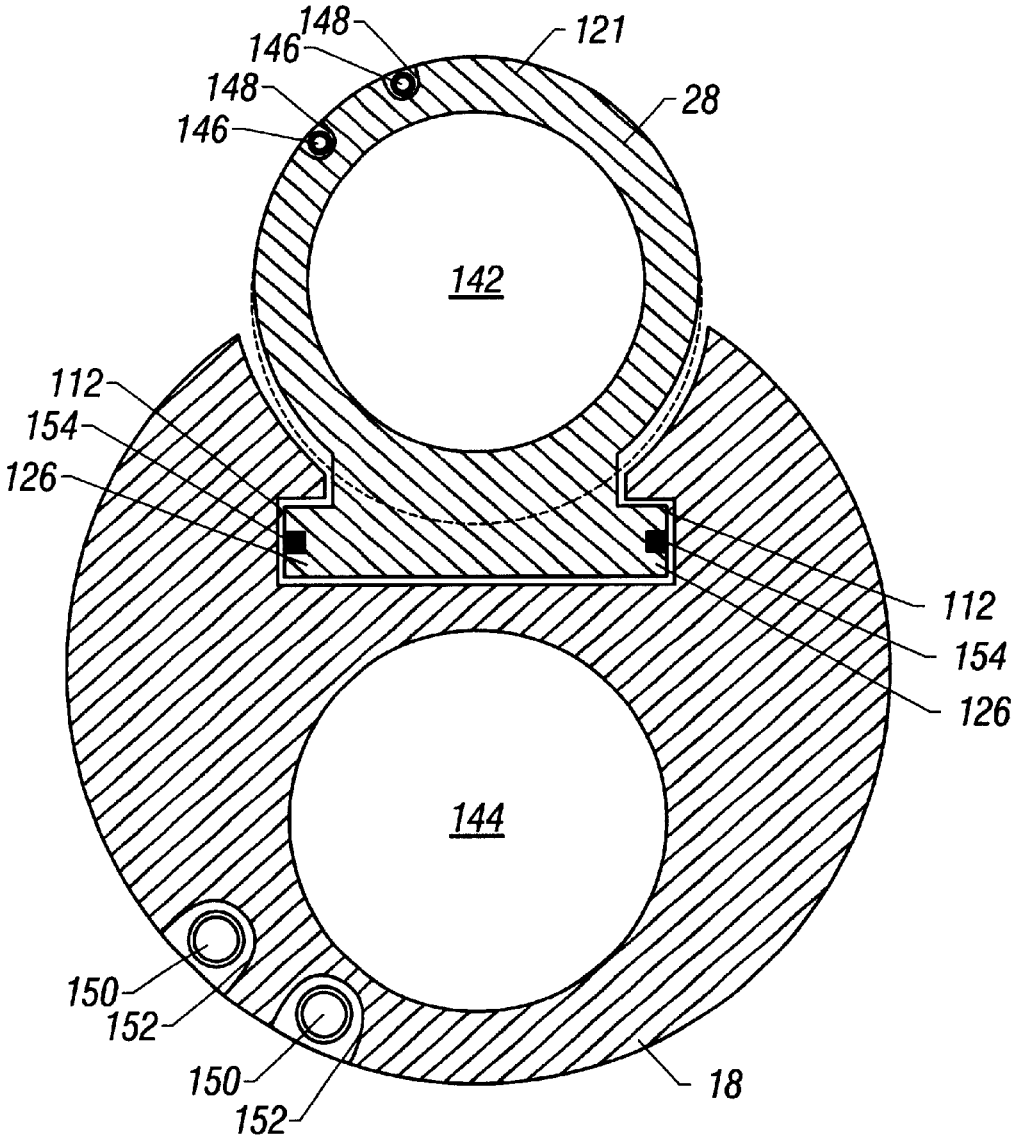

The offset of the inner bores 142 and 144 (and of the connector 28 and template 18) increases at cross-section 5—5, as shown in FIG. 5. Here, the bores 142 and 144 provide completely separate paths. In addition, the widths of the grooves 112 and rails 126 are reduced further. Near the lower end of the junction assembly, at cross-section 6—6, the connector 28 and template 18 are further offset from each other. The connector rails 126 and template grooves 112 near the distal end of the junction assembly are also shown.

In accordance with another feature of some embodiments of the invention, slots or conduits are also defined in the connector 28 and/or template 18 to enable the routing of communications lines (e.g., electrical lines, fluid pressure control lines, hydraulic lines, fiber optic lines, etc.). As shown in FIGS. 2–6, communications lines 146 are routed along conduits 148 defined on the outer surface of the connector housing 121. Although two sets of communications lines 146 and conduits 148 are illustrated in FIG. 2, other embodiments may have only a single set or more than two sets. The communications lines 146 enable the transmission and receiving of power and signals between devices located in the lateral branch bore 26 and devices located in the main bore 38 or at the well surface.

In addition to the communications lines 146 and conduits 148, similar communications lines 150 can also be extended along conduits 152 formed on the outer surface of the template 18 housing. Again, two sets of communications lines 150 and conduits 152 are illustrated for purposes of example. The communications lines 150 enable communications with devices located below the junction assembly.

Another feature of some embodiments is the presence of seals 154 formed between respective grooves 112 and rails 126 (as shown in FIGS. 2–6). The seals 154 are provided primarily to prevent the entry of solids from the surrounding formation and wellbore into the bores 142 and 144. In one embodiment, the seals 154 are elastomer seals—although other types of seals can be employed in other embodiments. In another embodiment, an adequate seal may be provided by engagement of each continuous rail 126 with a corresponding groove 112 (without the use of the seal 154). The engagement of the rail 126 and groove 112 provides a tortuous path that makes it difficult for solids to traverse from outside the junction assembly into the junction assembly. The tortuous path is provided by the plural edges or surfaces of the rail 126 being in abutment with corresponding plural edges or surfaces of the groove 112.

Figure 20:
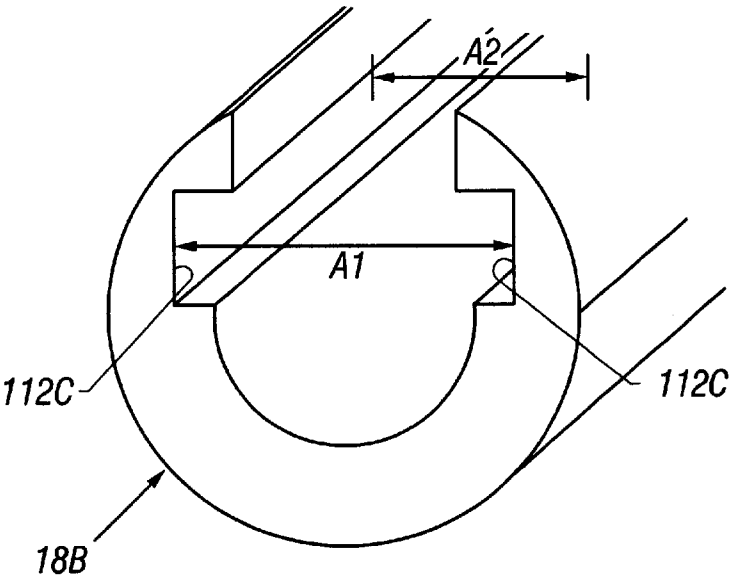
FIG. 20 illustrates another embodiment of a lateral branch template that has tapered grooves to receive rails of a corresponding lateral branch connector.

FIGS. 2–6 show rails 126 and grooves 112 that are generally parallel to each other and that are generally parallel along a longitudinal axis of the connector 28 or template 18. Alternatively, the rails 126 and/or grooves 112 can be non-parallel. Also, the pair of rails and pair of grooves do not need to be symmetrical along the longitudinal axis. An example of a non-parallel pair of grooves 112C is shown in FIG. 20. At one portion of a template 18B, the width between the grooves 112C is A1. At another portion of the template 18B, the width between the grooves 112C is reduced (A2). Thus the grooves 112C are generally tapered inwardly towards each other, forming a pair of non-parallel grooves. The rails of the connector can be similarly tapered. Alternatively, in other embodiments, other non-parallel arrangements of the rails and grooves are possible.

Figure 21:
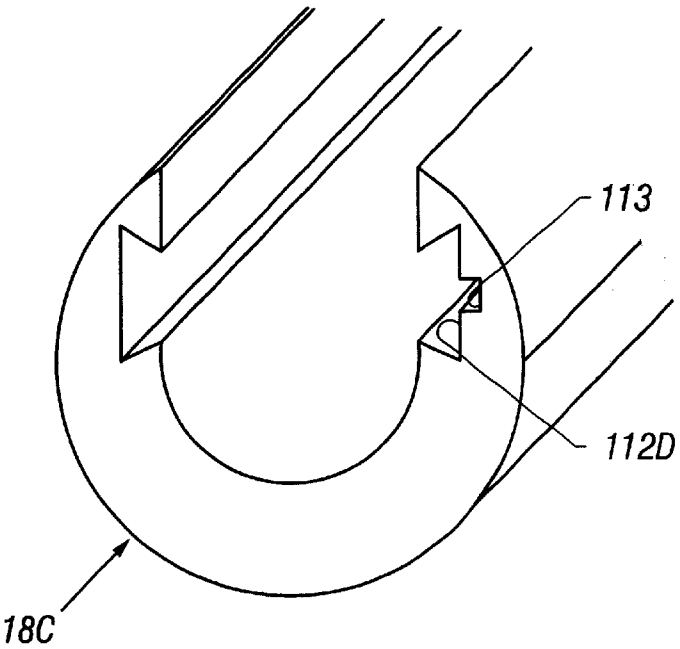
FIG. 21 illustrates yet a further embodiment of a lateral branch template that has asymmetrical grooves with respect to a longitudinal axis of the template.

FIG. 21 shows a pair of grooves 112D that are non-symmetrical along the longitudinal axis of a template 18C. In the drawing, the groove 112D on the right-hand side has a notch 113 that does not appear on the groove 112D on the left-hand side. Rails of the connector can also be non-symmetrical along its longitudinal axis.

Figure 10:
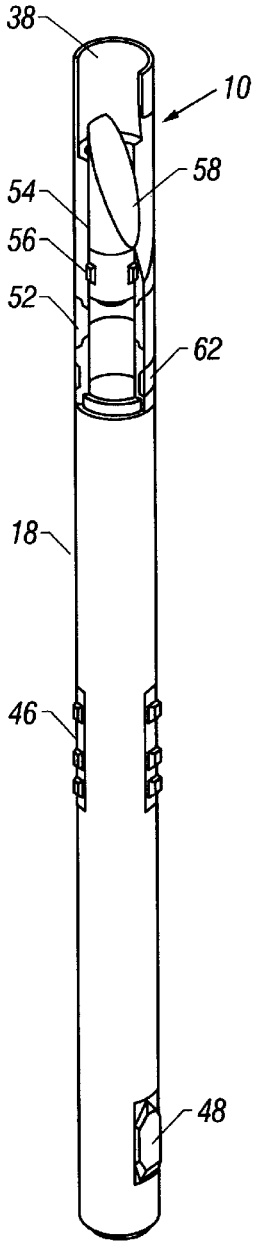
FIG. 10 is an isometric illustration in partial section of a lateral branch template having an upper portion cut away to show positioning of a diverter member in the template.
Figure 12:
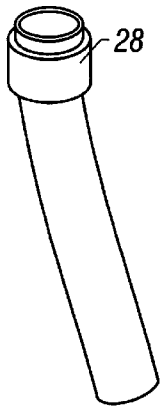
FIG. 12 is an isometric illustration of the lateral branch connector of FIG. 11.
Figure 13:
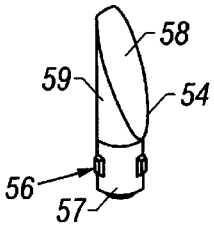
FIG. 13 is an isometric illustration of the diverter member of FIG. 10.
Figure 11:
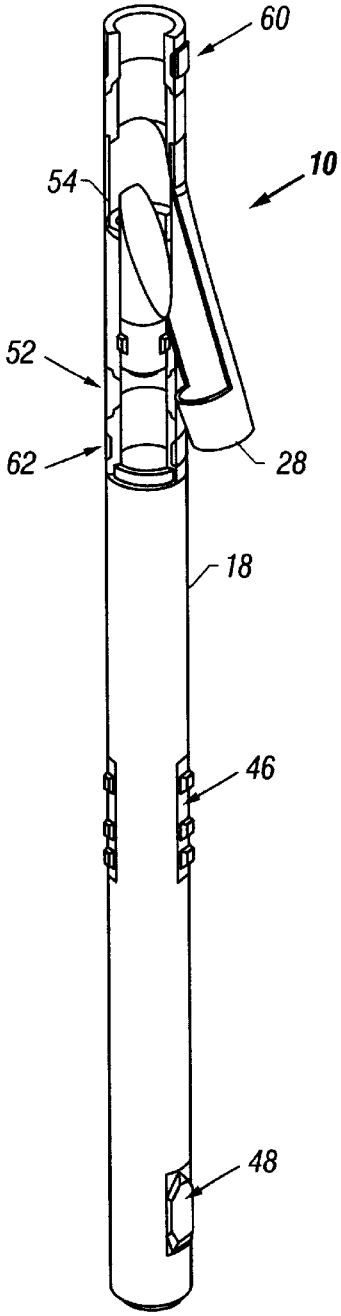
FIG. 11 is an isometric illustration of a lateral branch connector and isolation packers being in assembly with the lateral branch template.

FIGS. 10–12 collectively illustrate the lateral branch connection or junction assembly by means of isometric illustrations having parts thereof broken away and shown in section. The lateral branch template 18 supports positioning keys 46 and an orienting key 48 which mate respectively with positioning and orienting profiles of an indexing coupling set into the main well casing 12. If the lateral branch construction procedure is being accomplished in an existing well which is not provided with an indexing coupling, an indexing mechanism can be oriented and set within the existing well casing, thus permitting the lateral branch template to be accurately positioned with respect to a casing window that is milled in the casing and with respect to the lateral branch bore 26 that is drilled from the casing window 24.

An adjustment adapter mechanism shown at 52 in FIGS. 10 and 11 allows adjustment for depth and orientation between the lower section of the template and positioning keys 46 and the orienting key 48 and the upper section of the template 18 supporting the lateral branch connector 28. A diverter member 54 including selective keys 56 fits into the main production bore of the lateral branch template 18 and defines a tapered diverter surface 58 that is oriented to divert or deflect a tool being run through the main production bore 38 laterally through the casing window 24 and into the lateral branch bore 26. The lower diverter body structure 57 is rotationally adjustable relative to the tapered diverter surface 58 to thus permit selective orientation of the tool being diverted along a selective azimuth.

The selective orienting keys 56 of the diverter are seated within specific key slots of the lateral branch template 18 while the upper portion 59 of the diverter will be rotationally adjusted relative thereto for selectively orienting the tapered surface 58. Isolating packers 60 and 62 are interconnected with the lateral branch template and are positioned respectively above and below the casing window 24 and serve to isolate the template annular space respectively above and below the casing window.

According to one method for connecting a lateral branch liner to a main well casing, the main or parent well casing is located into the main well bore and supports one or more indexing devices that can be permanently installed in the parent casing below the junction. Indexing features include positive locating systems to position accurately the template 18 in depth and orientation with respect to the lateral window 24. The main well casing has one or a plurality of lateral windows referenced to the indexing device or devices to thus permit one or more lateral branch bores to be constructed from the main wellbore and oriented according to the desired azimuth and inclination for intersecting one or more subsurface zones of interest.

The lateral window(s) is typically milled after main well casing is set and cemented. In this case, the main well casing does not need to be oriented before cementing. Alternatively to the above, the lateral window can be pre-fabricated into a special vessel installed in line in the main well casing string. In this case, the main well casing requires orientation before cementing in order to let the orientation of the lateral branch conform with the well construction plan.

The lateral branch template 18 is properly located and secured into the main well bore by fitting into an indexing device to position accurately the template in depth and orientation with respect to the lateral window 24 of the main well casing. The lateral branch template 18 has adjustment components that are integrated into the lateral branch template 18 and which allow for adjusting the position and orientation of the lateral branch template with respect to the lateral casing window. The main production bore 38 allows fluid and production equipment to pass through the lateral branch template with a minimum restriction so access in branches located below the junction is still allowed for completion or intervention work after the template 18 has been set. The lateral opening 29 in the lateral branch template 18 provides space for passing a lateral liner and for locating the lateral branch connector 28 which fits in it with tight tolerances taking advantage of controlled prefabricated geometries.

The lateral branch template 18 incorporates a landing profile and a latching mechanism that allows supporting and retaining the lateral branch connector 28 so it is positively connected to the main production bore 38. The lateral branch template 18 also incorporates guiding and interlocking features (continuous grooves 112 shown in FIGS. 1–9) that, in cooperation with corresponding continuous rails 126 of the lateral branch connector 28, allow conveyance of the lateral branch connector 28 through the lateral opening. The continuous grooves 112 and rails 126 also support the lateral branch connector 28 against forces that may be induced by shifting of the surrounding formation or by the fluid pressure of produced fluid in the junction.

The lateral branch template 18 also provides a selective landing profile and associated orienting profile in which can fit a diverter used to direct equipment from uphole through the casing window and toward the lateral branch bore. The upper and lower ends of the lateral branch template are treated so production tubing can be connected without diameter restriction by means of conventional production tubular connections. The lateral branch template provides a polished bore receptacle for eventual tie back at its upper portion and is provided with a threaded connection at its lower portion. As an option, the annular space between lateral branch template and main well casing is isolated below and above the lateral window by means of annular packer elements to provide the well ultimately and selectively with isolation of either the lower section of the main production bore or the lateral branch bore.

Figure 14:
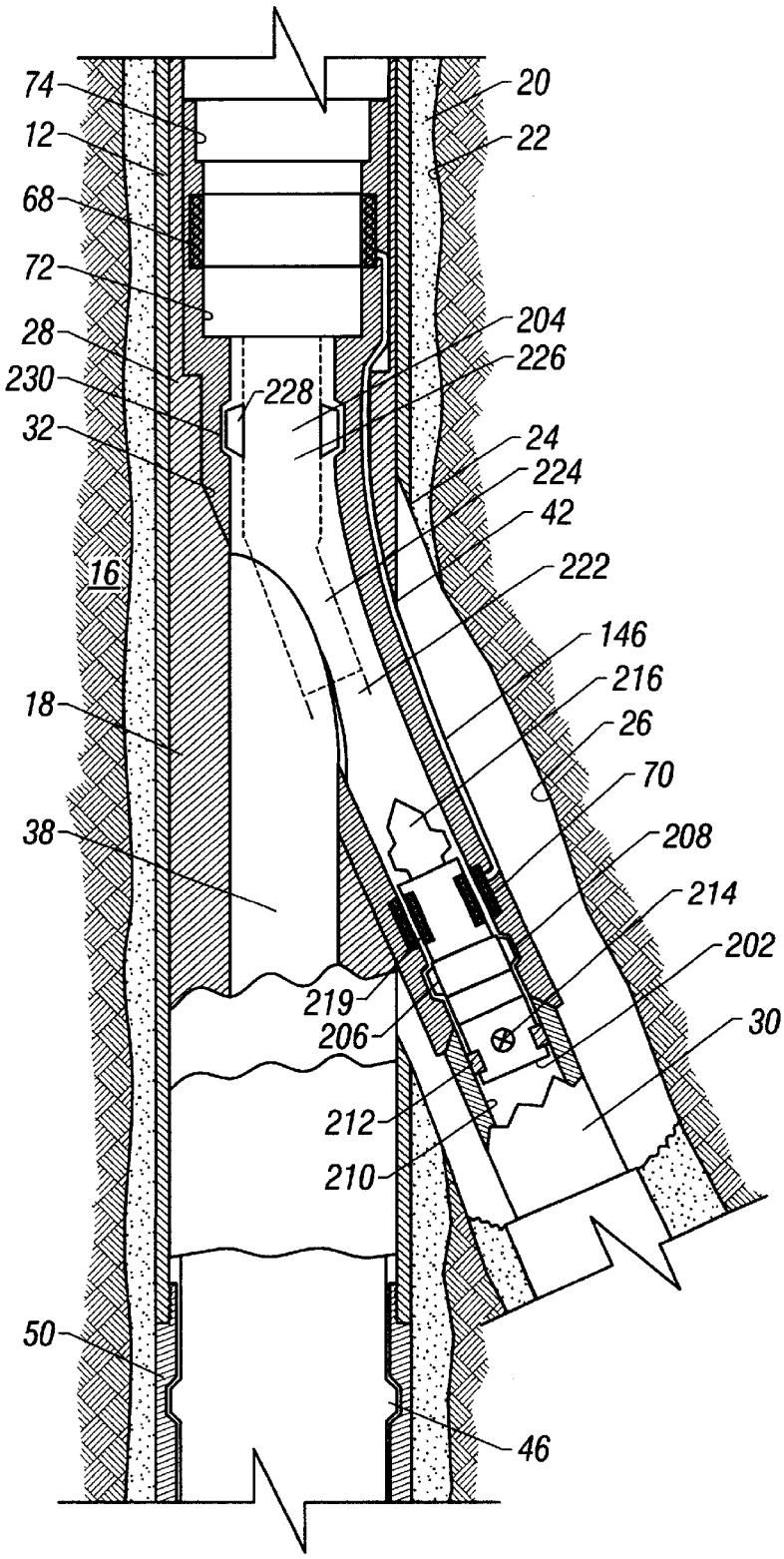
FIG. 14 is a longitudinal sectional view of a lateral branch template, a lateral branch connector engaged in the lateral branch template, a kick-over tool, and an intelligent completions device capable of being carried by the kick-over tool, the intelligent completions device positionable in a lateral branch bore.

Referring to FIG. 14, once the lateral connection assembly is set at the junction between the main bore and the lateral branch 26, an intelligent completions device 202 can be placed somewhere along the lateral branch bore 26 using an intervention tool, which in one embodiment includes a kick-over tool 204 (shown in dashed profile). The kick-over tool runs the intelligent completion device 202 into the main well bore 22. In one embodiment, the intelligent completions device 202 is an electrically controllable valve that can be placed in the lateral branch bore 26 to control in-flow of fluid from the lateral branch bore 26 to the main bore 38 (above the junction). In other embodiments, other types of intelligent completion devices that can be positioned in the lateral branch bore 26 include gauges, sensors, control devices, and so forth.

The valve 202 has one or more locking dogs 206 that are engageable in corresponding one or more profiles 208 formed in the lateral branch connector 28. Alternatively, if the valve 202 is positioned further downstream in the lateral branch bore 26, the profile(s) 208 are formed in the lateral branch liner 30. An inner surface of the liner 30 (or alternatively the lateral branch connector 28) provides a seal bore 210 in which a seal 212 carried by the valve 202 is sealingly engageable. The valve device 202 includes a valve 214 that can be actuated between an open position and a closed position, and optionally, to one or more intermediate choke positions, to control the flow of fluid through a longitudinal bore of the valve device 202.

An engagement adapter 216 at the upper end of the valve device 202 is engageable by a corresponding member 222 on the kick-over tool 204. The kick-over tool 204 has a section 224 that is pivotably mounted with respect to a main section 226.

Actuating members 228 are mounted on the outside of the kick-over tool 204 and are adapted for engagement in profiles 230 formed in the connector 28. Alternatively, the profiles 230 can be formed in the casing 12 if the actuating members 228 of the kick-over tool 204 are formed further upwardly. When the actuator members 228 are engaged in the profiles 230, the kick-over tool 204 is triggered to allow the lower section 224 to pivot towards the lateral branch bore 26. The lower section 224 can be lowered into the lateral branch bore 26 to enable engagement of the locking dogs 206 on the outside of the valve device 202 in the profiles 208 of the lateral branch connector 28 or the lateral branch liner 30. Once the valve device 202 is engaged in the profiles 208, the kick-over tool 220 can be disengaged from the valve 202. The kick-over tool 220 is then raised to a surface, leaving the valve device 202 behind.

As an option, the upper and or lower ends of the lateral branch template 18 may be equipped with an inductive coupler mechanism to enable the communication of electrical power and signaling with the valve 202 through the template 18 and along the main completion conduit (e.g., production tubing, etc.). The inductive coupler mechanism shown in FIG. 14 provides a contact-less coupling of electrical power and signaling. Alternatively, a contact-based electrical connection or an electromagnetic based communications can be employed.

The lateral branch connector 28 is shown to be provided with an inductive coupler portion 68. A tubing encapsulated cable or permanent downhole cable, which can be one of the communications lines 146 shown in FIGS. 2–6, extends from the inductive coupler portion 68 substantially the length of the lateral branch connector 28 and terminates in another inductive coupler portion 70. The parent bore inductive coupler portion 68 is located within a polished bore receptacle 72 having an upper polished bore section 74 that is typically engaged by a seal located at the lower end of a production conduit.

Although not shown, a power supply and control line extends along the production conduit. The power supply and control line terminates in an inductive coupler portion (not shown) at the lower end of the production conduit. When the production conduit is engaged in the polished bore receptacle 72, the inductive coupler portion connected to the power supply and control line is inductively coupled to the parent bore inductive coupler portion 68. The upper end of the power supply and control line is connected to a well control unit (or to a downhole control unit).

Electrical energy is inductively coupled to the parent bore inductive coupler portion 68, which electrical energy is communicated over the cable 146 to the lateral branch inductive coupler portion 70. The electrical energy in the inductive coupler portion 70 is inductively coupled to an inductive coupler portion 219 in the valve 202. The electrical energy (including power and signaling) is communicated to power the valve 202 and to actuate the valve 202 between an open position, a closed position, and optionally, at least one intermediate choke position.

In an alternative embodiment, the connector 28 is connected to a lower end of a production tubing or other completion equipment so that the connector 28 and tubing or other completion equipment can be run into the wellbore together. In this arrangement, an electrical cable or conductor can be run from the connector 28 all the way to the well surface.

An efficient method and apparatus is thus provided to position an intelligent completions device in the lateral branch bore and to communicate with such an intelligent completions device. The ability to position and communicate with intelligent completions devices in a lateral branch bore provides useful tasks to control and to enhance the productivity of the lateral branch bore 26.

In a well having at least one lateral branch and a main well bore, the issue of commingling fluids from different zones (e.g., fluid from a lateral branch and fluid from a zone in the main well bore) arises. Sometimes it may not be desirable to commingle fluids from different sources. For example, a well having multiple lateral branches may have several owners, with a first lateral branch belonging to a first owner and a second lateral branch belonging to a second owner, and so forth. In that situation, and in other situations where commingling is undesired, a method and apparatus according to some embodiments of the present invention enables separate flow of fluids.

Flow control devices are provided at the junction so that fluid flow control can occur at the junction. The flow control devices can be remotely controlled so that accurate amounts of the fluid flow from different sources (from the lateral branch and from the main well bore) can be provided.

Figure 15:
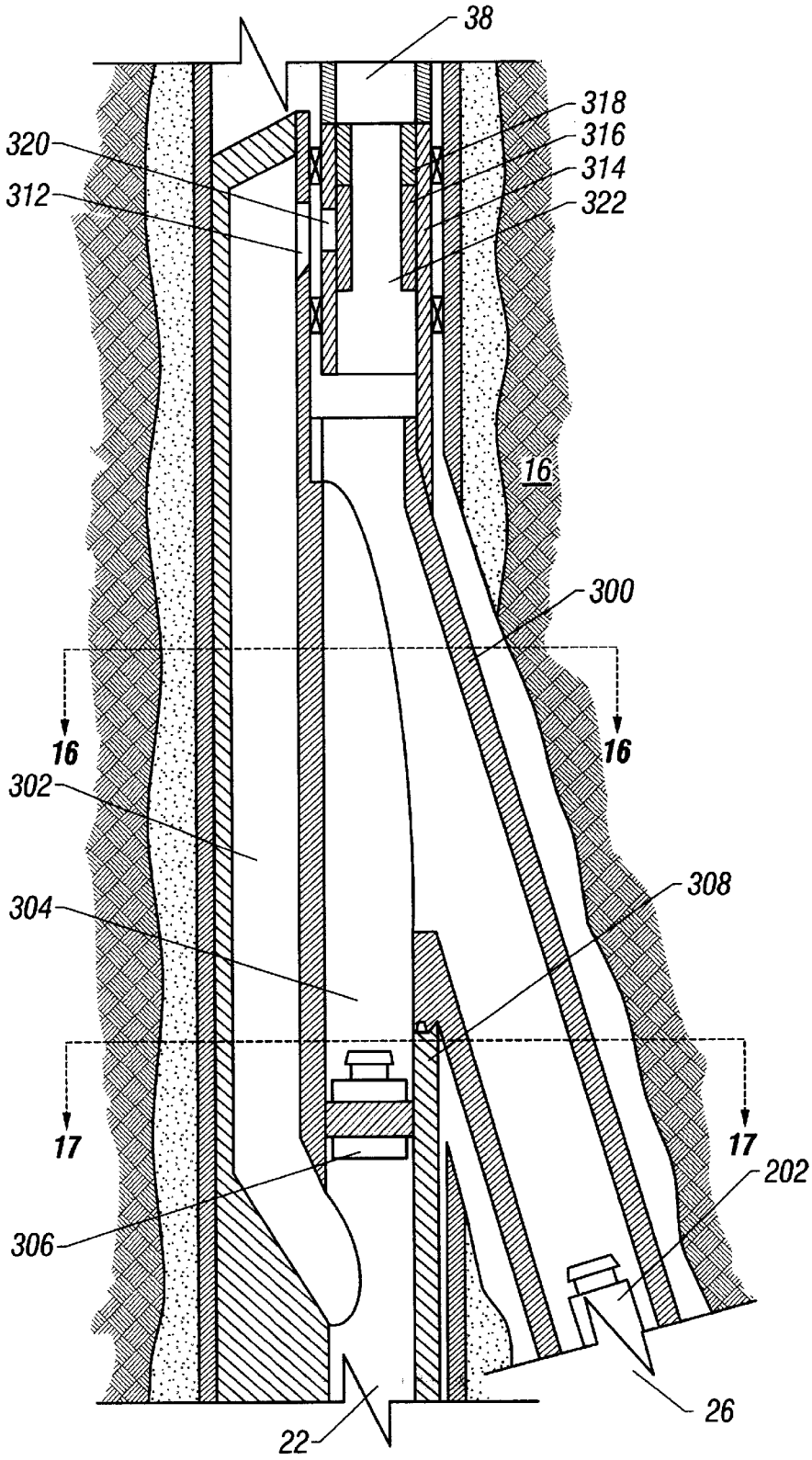
FIG. 15 is a longitudinal sectional view of a lateral branch template and a lateral branch connector engaged in the lateral branch template, the lateral branch template having an intervention bore and an offset fluid flow bore, the intervention bore being plugged by a retrievable plug.

As shown in FIG. 15, a lateral branch connector 300 (similar to connector 28 except with differences discussed here) is connected in a lateral branch template 308 to form a junction assembly between the main well bore 22 and the lateral branch bore 26. Unlike the template 18 in the embodiments described above, the template 308 includes a production flow path 302 and an intervention path 308. Fluid flowing upwardly through the main bore 22 is routed through the production bore 302 in the template 308 to bypass a plug 306 that is set inside the intervention bore 304. The plug 306 is a retrievable plug that can be retrieved to the well surface if it is desired to run an intervention tool into the main bore 22 below the junction assembly.

Both the production bore 302 and the intervention bore 304 extends generally longitudinally along the template 308. In the illustrated embodiment, the production bore 302 is offset to one side of the template 308, while the intervention bore 304 is generally aligned with the main bore 22 to enable the running of an intervention tool through the intervention bore 304 into the main bore 22. An in-flow control device (such as the valve 202 in FIG. 14) controls the flow of fluid from the lateral branch bore 26 past the flow control device 310.

The upper end of the production bore 302 in the template 308 leads to a radial port 312 that is in communication with a valve assembly 314. In one embodiment, the valve assembly 314 includes a sleeve valve 316 that is actuatable between an open position and a closed position. Optionally, the sleeve valve 316 can also be actuated to one or more intermediate choke positions. The sleeve valve 316 is connected to an operator mandrel 318 that is moveable by an actuator (not shown) of the valve assembly 314 in a longitudinal up and down direction. When the valve 316 is open, fluid can flow from the production bore 302 of the template 308 through the radial bore 312 and radial bore 320 of the valve assembly 314 into the inner bore 322 of the valve assembly 314. Fluid flow can then proceed up the upper main bore 38. Although the radial bores 312 and 320 are referred to in the singular, other embodiments may have plural radial bores 312 and 320 to provide a larger cross-sectional flow area.

When the valve 316 is closed, and the in-flow control device 310 is open, then fluid flows through the flow control device 202 in the lateral branch bore 26 into the template 308. Flow proceeds up the template 308 into the inner bore 322 of the valve assembly 314, and fluid continues up into the upper main bore 38.

Figure 16:
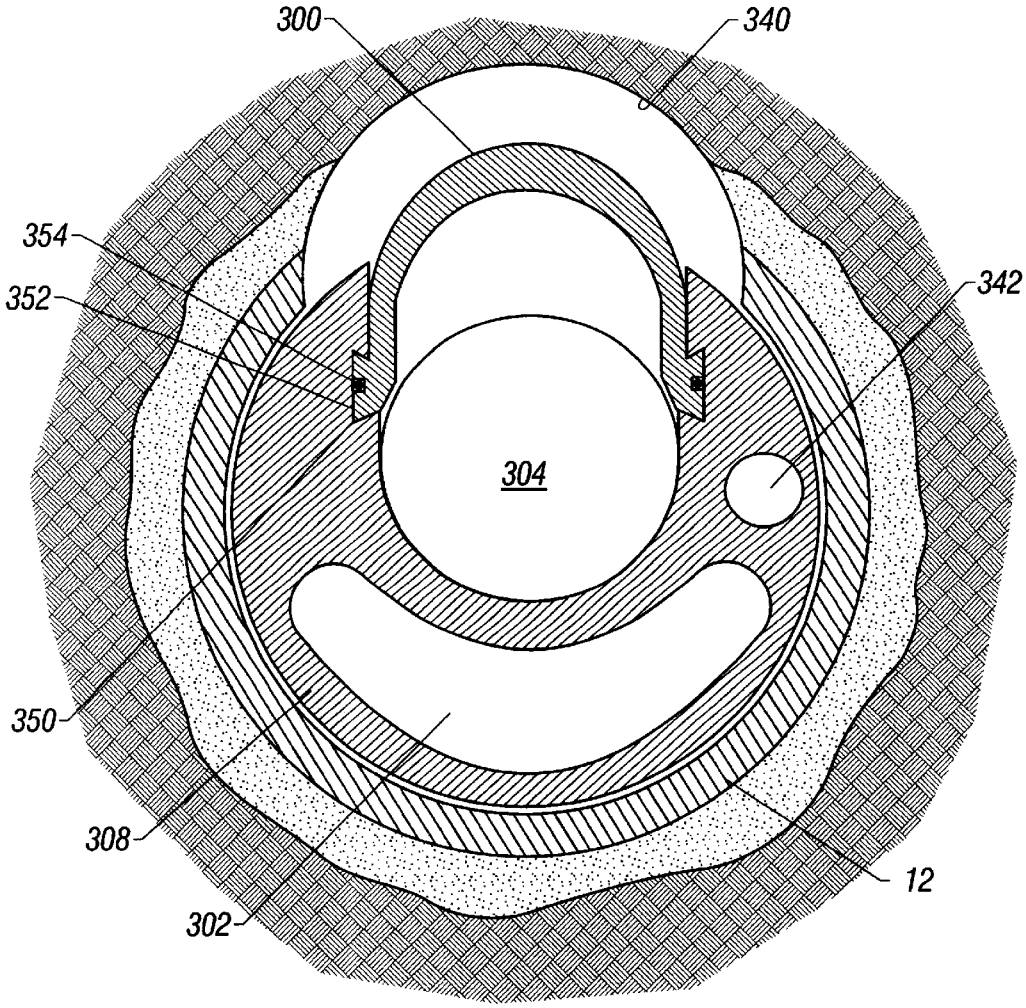
FIGS. 16 and 17 are cross-sectional views of portions of the assembly of FIG. 15 at section lines 16—16 and 17—17, respectively.
Figure 17:
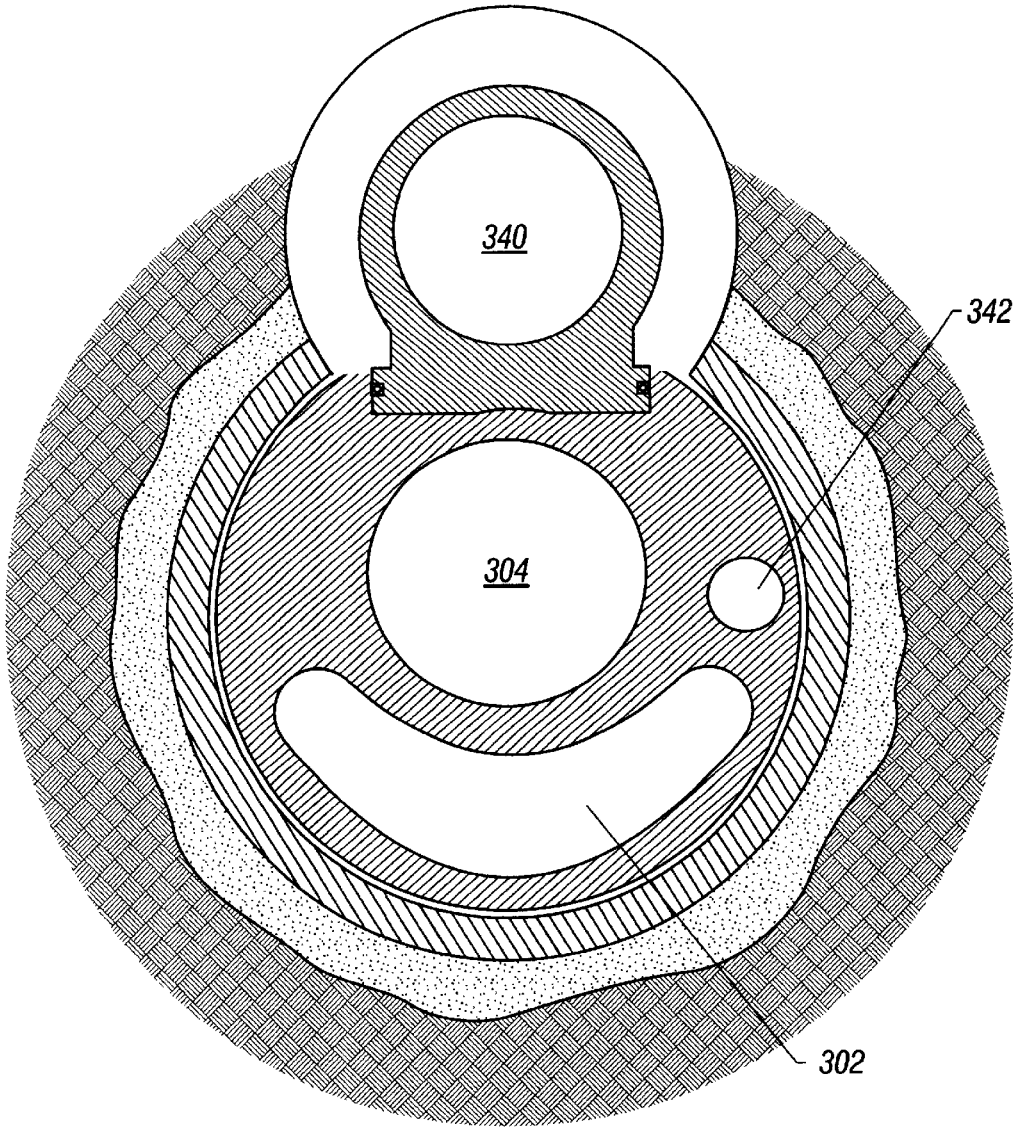

Cross-sectional views of the junction assembly of FIG. 15 are shown in FIGS. 16 and 17. FIG. 16 shows a cross-sectional view taken at section 16—16, while FIG. 17 shows a cross-sectional view taken at section 17—17. The offset production bore 302 in the template 308 has generally a flattened shape on one side of the template 308. The intervention bore 304 is generally cylindrical in shape and is closer to the center axis of the template 308. At the section 16—16, the intervention bore 304 overlaps an inner bore 340 of the lateral branch connector 300.

In one embodiment, the connector 300 also includes a pair of continuous rails 352 (similar to rail 126 in FIGS. 8A–8B) for inter-engagement with a corresponding pair of continuous grooves 350 in the template 308. Seals 354 can also be provided between the rail 352 and groove 350 to prevent inflow of solids into the production path. FIG. 17 shows a section of the junction assembly further downstream, where the inner bore 340 is completely offset from the intervention bore 304 of the template 308. Also, the widths of the rails 352 and grooves 350 are also narrowed at 17—17.

As shown in FIGS. 16 and 17, the template 308 also defines another offset bore 342, which can be used to carry a control line (e.g., an electrical control line, a hydraulic control line, etc.).

Figure 18:
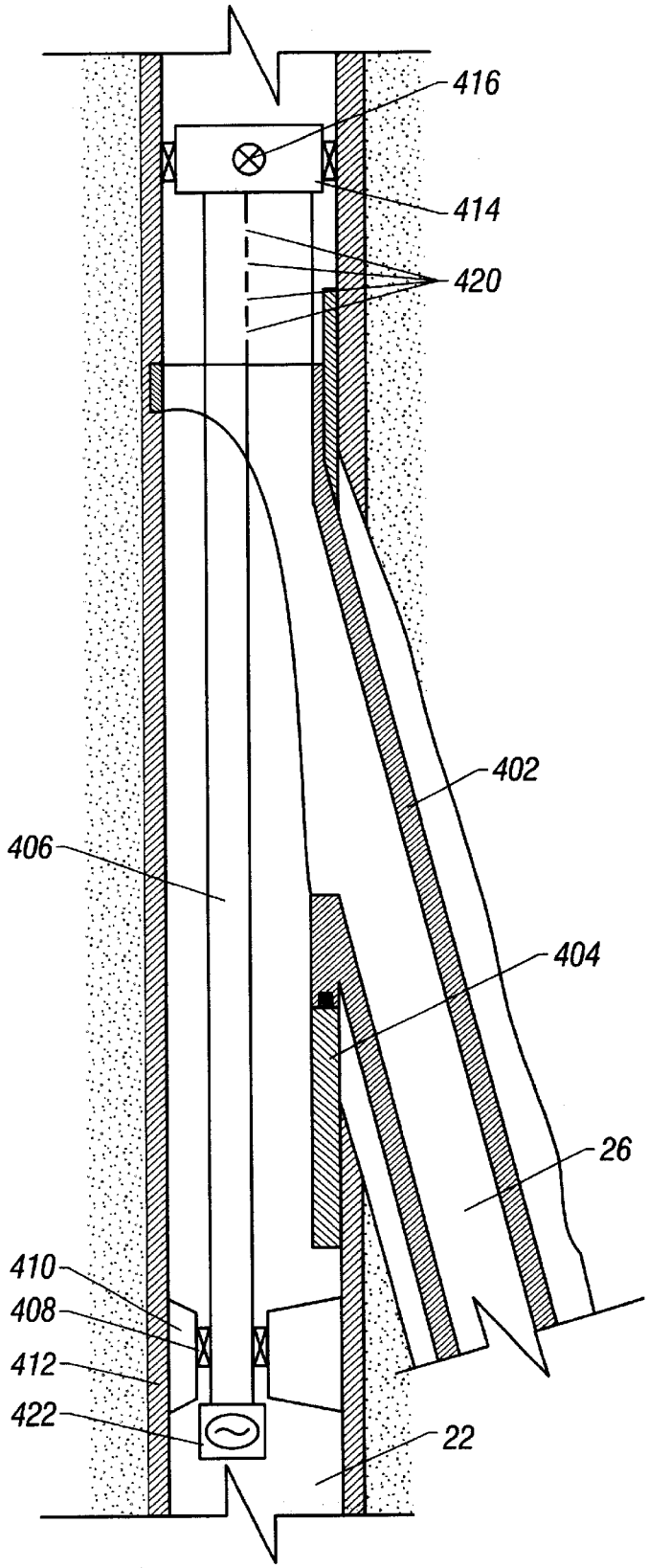
FIG. 18 is a longitudinal sectional view of a junction assembly having a lateral branch template, a lateral branch connector, a flow conduit, and flow control devices to control fluid flow in the main bore and lateral branch bore through the junction assembly, in accordance with an embodiment.

Referring to FIG. 18, another embodiment of a flow control mechanism at the junction assembly is shown. In the illustrated arrangement, a lateral branch connector 402 is connected in a lateral branch template 404. In this embodiment, an in-flow control device is not needed in the lateral branch bore 26 (although one can be positioned in the lateral branch bore 26 if desired).

To provide the desired flow control in the junction assembly, a tubing 406 extends through the template 404, with a packer or other sealing element 408 providing a seal between the external surface of the tubing 406 and protruding members 410 attached to casing 412. In an alternative embodiment, instead of protruding members 410 attached to the wall of the casing 412, the packer or other sealing element can have a wider outer diameter to engage the inner wall of the casing 412.

The tubing 406 is connected at its lower end to a valve 422, which controls the flow of fluids from the lower main bore 22 into the tubing 406. The upper end of the tubing 406 extends to a valve device 414 that is sealingly engaged to the inner wall of the casing 412. In one example, the valve device 414 includes a ball valve 416. Alternatively, the valve device 414 includes a flapper valve, a sleeve valve, or other type of valve.

To allow communication of fluids from the lateral branch 26, openings 420 (such as in the form of slots) are formed on the outer wall of the tubing 406. Flow from the lateral branch 26 enters the tubing 406 for communication to the well surface. To enable fluid flow from the lower main bore 22, the valve 422 is opened, as is the valve 416. Optionally, a flow control device in the lateral branch 26 can be closed to prevent commingling of fluids in the junction assembly. In another setting, the valve 422 can be closed and fluid flow from the lateral branch 26 is directed through the valve 416 into the upper main bore 38.

Figure 19:
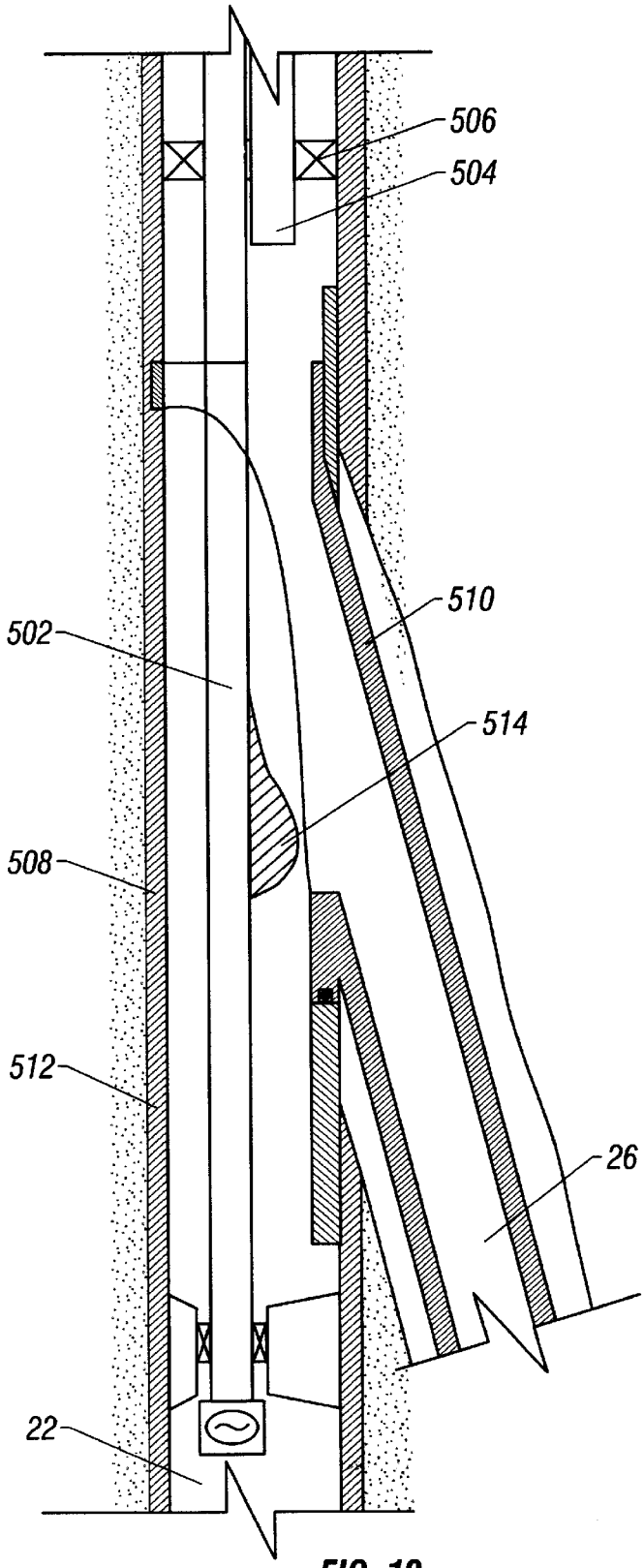
FIG. 19 is a longitudinal sectional view of a junction assembly having a lateral branch template, a lateral branch connector, a flow conduit having a diverter, and flow control devices to control fluid flow in the main bore and lateral branch bore through the junction assembly, in accordance with another embodiment.

Referring to FIG. 19, yet another embodiment is illustrated. In this embodiment, flow control devices at the junction assembly are not used. However, plural flow conduits 502 and 504 are employed. The flow conduits 502 and 504 (e.g., production tubings) in one embodiment extend to the well surface. A dual packer 506 provides a sealing engagement of the flow conduits 502 and 504 inside the bore defined by a casing 508. The conduit 504 receives fluid flow from the lateral branch 26, while the flow conduit 502 receives fluid flow from the lower portion of the main bore 22. In the illustrated embodiment of FIG. 19, a lateral branch connector 510 is engaged in a template 512 (similar to those of the other embodiments described herein).

In accordance with this embodiment, a diverter 514 is placed on the outside of the flow conduit 502 to enable intervention tools lowered down the flow conduit 504 to engage the diverter 514 so that the intervention tool is directed into the lateral branch 26. The diverter 514 can be integrally formed on the outer surface of the flow conduit 502, or alternatively, the diverter 514 is attached by rivets, screws, and the like, to the flow conduit 502. Use of a diverter 514 attached to the flow conduit 502 avoids the need for a separate diverter tool in the wellbore.

Figure 22:
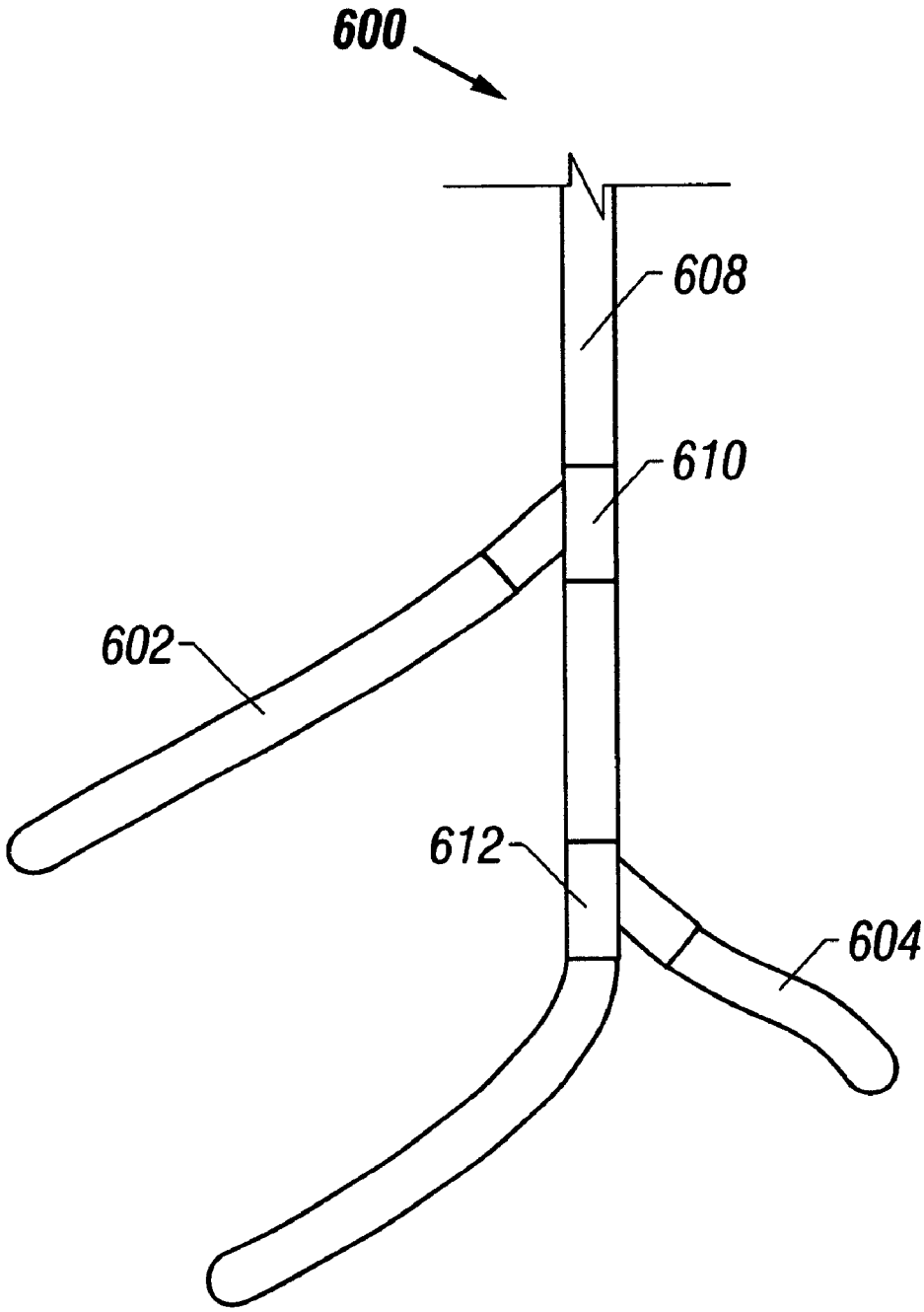
FIG. 22 illustrates a well having plural junction assemblies in accordance with an embodiment.

Referring to FIG. 22, a well 600 has plural lateral branches 602 and 604. The lateral junction assembly according to one of various embodiments can be used proximal each junction of the main bore 608 and lateral branch 602 or 604. As illustrated, a first lateral junction assembly 610 is positioned proximal the junction to the lateral branch 602, and a second lateral branch assembly 612 is positioned proximal the junction to the lateral branch 604.

While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A lateral junction apparatus for defining a junction between a main wellbore and a lateral branch, comprising:

a template having a lateral window for positioning proximal the junction;

a connector adapted to be engaged with the template, the connector adapted to be directed by the template through the template lateral window; and a sealing element between the template and the connector, the sealing element adapted to define a continuous fluid seal path around the lateral window, wherein the template comprises a first inter-engagement member and the connector comprises a second inter-engagement member, the first and second inter-engagement members adapted to engage each other, wherein one of the first and second inter-engagement members comprises a groove and the other one of the first and second inter-engagement members comprises a rail.

2. The lateral junction apparatus of claim 1, wherein the rail is adapted to continuously extend along a length that corresponds substantially to a length from one end of the template window to another end of the template window.

3. A lateral junction apparatus comprising:

a template having a first continuous inter-engagement member, the template having a window formed therethrough; and a connector having a second continuous inter-engagement member adapted to cooperate with the first continuous inter-engagement member to guide a portion of the connector through the window of the template, the connector and template being in engagement along a first length, each of the first and second continuous inter-engagement members extending substantially the entire first length.

4. The lateral junction apparatus of claim 3, wherein the template has at least another first continuous inter-engagement member.

5. The lateral junction apparatus of claim 4, wherein the connector has at least another second continuous inter-engagement member, each of the first continuous inter-engagement members adapted to engage a corresponding one of the second continuous inter-engagement members.

6. The lateral junction apparatus of claim 5, wherein each first inter-engagement member comprises one of a continuous groove and a continuous rail, and each second inter-engagement member comprises the other one of the continuous groove and continuous rail.

7. The lateral junction apparatus of claim 3, wherein the first inter-engagement member comprises one of a continuous groove and continuous rail, and the second inter-engagement member comprises the other one of the continuous groove and continuous rail.

8. The lateral junction apparatus of claim 7, wherein the continuous groove has a width varying along a length of the continuous groove.

9. The lateral junction apparatus of claim 8, wherein the continuous groove has a proximal end and a distal end, the proximal end having a width greater than the distal end.

10. The lateral junction apparatus of claim 9, wherein the width of the continuous groove decreases from the proximal end to the distal end.

11. The lateral junction apparatus of claim 10, wherein the proximal end of the continuous groove has an enlarged portion to guide the continuous rail into the continuous groove.

12. The lateral junction apparatus of claim 8, wherein the continuous rail has a width varying along a length of the continuous rail.

13. The lateral junction apparatus of claim 12, wherein the varying width of the continuous rail is adapted to correspond to the varying width of the continuous groove to enable engagement of the continuous rail and continuous groove.

14. The lateral junction apparatus of claim 3, wherein at least one of the first and second inter-engagement members is generally symmetrical along a plane containing a longitudinal axis of one of the template and connector.

15. The lateral junction apparatus of claim 3, wherein at least one of the first and second inter-engagement members is generally asymmetrical along a longitudinal axis of one of the template and connector.

16. The lateral junction apparatus of claim 3, wherein the template has a pair of first continuous inter-engagement members, the pair being generally parallel to each other.

17. The lateral junction apparatus of claim 3, wherein the template has a pair of first continuous inter-engagement members, the pair being generally non-parallel to each other.

18. The lateral junction apparatus of claim 3, wherein the connector has a pair of second continuous inter-engagement members, the pair being generally parallel to each other.

19. The lateral junction apparatus of claim 3, wherein the connector has a pair of second continuous inter-engagement members, the pair being generally non-parallel to each other.

20. The lateral junction apparatus of claim 3, wherein the first and second inter-engagement members have surfaces that when engaged with one another define a tortuous path to prevent entry of debris from outside the lateral junction apparatus into an inner bore of the lateral junction apparatus.

21. The lateral junction apparatus of claim 3, wherein each of the first and second inter-engagement members extends substantially the entire first length without any break.

22. The lateral junction apparatus of claim 3, wherein the template has a bore, and wherein the connector is adapted to extend through the bore.

23. The lateral junction apparatus of claim 22, wherein a second portion of the connector is positioned inside the template bore, the second portion having a length equal to the first length.

24. The lateral junction apparatus of claim 3, wherein the connector has an inner bore to enable communication with a lateral bore.

25. A lateral junction apparatus comprising:

a template having a first continuous inter-engagement member, the template having a window formed therethrough; and a connector having a second continuous inter-engagement member adapted to cooperate with the first continuous inter-engagement member to guide a portion of the connector through the window of the template, the connector and template being in engagement along a first length, each of the first and second continuous inter-engagement members extending substantially the entire first length, wherein each of the first and second inter-engagement members extends from one end of the template window to another end of the template window.

26. The lateral junction apparatus of claim 25, further comprising a seal extending along a length of each of the first and second inter-engagement members to provide sealing engagement of the template and connector.

27. The lateral junction apparatus of claim 26, wherein the seal is carried by one of the first and second inter-engagement members.

28. The lateral junction apparatus of claim 27, wherein one of the first and second inter-engagement members comprises a rail, the seal carried by the rail.

29. The lateral junction apparatus of claim 27, wherein one of the first and second inter-engagement members comprises a groove, the seal carried by the groove.

30. A lateral junction apparatus to provide a connection between a main bore and a lateral branch bore, comprising:

a template having a bore and window proximal the lateral branch bore;

a connector adapted for engagement inside the template bore, a portion of the connector extending through the template window into the lateral branch bore, the connector defining a conduit adapted to extend into the lateral branch bore; and a communications line extending along the conduit and adapted to extend into the lateral branch bore.

31. The lateral junction apparatus of claim 30, wherein the communications line extends from the main bore to the lateral branch bore.

32. The lateral junction apparatus of claim 30, wherein the communications line comprises an electrical line.

33. The lateral junction apparatus of claim 30, wherein the communications line comprises one or more hydraulic control lines.

34. The lateral junction apparatus of claim 30, wherein the communications line comprises a fiber optic line.

35. The lateral junction apparatus of claim 30, wherein the conduit comprises a groove extending along a length of the connector housing.

36. The lateral junction apparatus of claim 30, wherein the template defines a conduit, the lateral junction apparatus further comprising another communications line extending along the template conduit.

37. A junction assembly for use at a junction between a main bore and a lateral branch bore, comprising:

a template having a lateral window and defining a first longitudinal bore and a second longitudinal bore offset from the first longitudinal bore, the first longitudinal bore being substantially aligned with the main bore to enable running an intervention tool through the main bore and the first longitudinal bore to a location downstream of the junction assembly, the template having a first inter-engagement member extending generally along a longitudinal axis of the template; and a lateral branch connector adapted to be engaged with the template to provide a communications path to the lateral branch bore, the lateral branch connector having a second inter-engagement member adapted to cooperate with the first inter-engagement member to guide the lateral branch connector through the lateral window of the template.

38. The junction assembly of claim 37, further comprising a plug positioned in the first longitudinal bore to prevent fluid flow in the first longitudinal bore during production.

39. The junction assembly of claim 38, wherein the second longitudinal bore provides a production flow path during production.

40. The junction assembly of claim 37, further comprising a first valve to control fluid flow through the second longitudinal bore.

41. The junction assembly of claim 40, further comprising a second valve to control fluid flow in the lateral branch bore.

42. The junction assembly of claim 37, wherein the second inter-engagement member extends generally along a longitudinal axis of the lateral branch connector.

43. A junction assembly for use at a junction between a main bore and a lateral branch bore, comprising:

a template having a lateral window adapted for alignment with the lateral branch bore, the template having a first inter-engagement member extending generally along a length of the template;

a lateral branch connector engaged with the template, a portion of the lateral branch connector positioned through the lateral window, the lateral branch connector having a second inter-engagement member adapted to cooperate with the first inter-engagement member to guide the lateral branch connector through the lateral window;

a structure defining a conduit for communicating fluid between a first region of the main bore upstream of the junction and a second region of the main bore downstream of the junction; and at least one flow control device to selectively control flow from the second region of the main bore and the lateral branch bore.

44. The junction assembly of claim 43, further comprising a diverter attached to the structure, the diverter positioned to divert downhole tools into the lateral branch bore.

45. The junction assembly of claim 43, wherein the second inter-engagement member extends generally along a longitudinal axis of the lateral branch connector.

46. A system for use in a well having plural lateral branches, comprising:

a first lateral junction apparatus positioned proximal a first lateral branch;

a second lateral junction apparatus positioned proximal a second lateral branch; and each of the first and second lateral branch apparatus comprising a template with a lateral window and a connector engaged with the template, a portion of the connector directed through the lateral window, the template having a first inter-engagement member extending generally along a longitudinal axis of the template, and the connector having a second inter-engagement member adapted to cooperate with the first inter-engagement member to guide the connector through the lateral window of the template.

47. The system of claim 46, wherein each of the first and second lateral junction apparatus comprises a sealing element providing a closed, continuous fluid seal path around the lateral branch.

48. The system of claim 46, wherein the second inter-engagement member extends generally along a longitudinal axis of the connector.

* * * * *

UNITED STATES PATENT AND TRADEMARK OFFICE

CERTIFICATE OF CORRECTION

PATENT NO. : 6,568,469 B2
DATED : May 27, 2003
INVENTOR(S) : Herve Ohmer et al.

It is certified that error appears in the above-identified patent and that said Letters Patent is hereby corrected as shown below:

Title page,
Item [73], Assignee, delete "Sugarland", and insert -- Sugar Land --.
Item [74], *Attorney, Agent, or Firm*, delete "Brigitte L. Jeffrey", and insert -- Brigitte L. Jeffery --.

Signed and Sealed this

Fifteenth Day of July, 2003

JAMES E. ROGAN
*Director of the United States Patent and Trademark Office*